US012447371B2

(12) United States Patent
Powell

(10) Patent No.: US 12,447,371 B2
(45) Date of Patent: Oct. 21, 2025

(54) ADJUSTABLE ARM ON AN EXERCISE DEVICE

(71) Applicant: iFIT Inc., Logan, UT (US)

(72) Inventor: Wade A. Powell, Millville, UT (US)

(73) Assignee: iFIT Inc., Logan, UT (US)

( * ) Notice: Subject to any disclaimer, the term of this patent is extended or adjusted under 35 U.S.C. 154(b) by 299 days.

(21) Appl. No.: 17/963,822

(22) Filed: Oct. 11, 2022

(65) Prior Publication Data

US 2023/0116715 A1 Apr. 13, 2023

Related U.S. Application Data

(60) Provisional application No. 63/254,470, filed on Oct. 11, 2021.

(51) Int. Cl.
*A63B 21/00* (2006.01)
*A63B 21/22* (2006.01)

(52) U.S. Cl.
CPC ..... *A63B 21/00072* (2013.01); *A63B 21/153* (2013.01); *A63B 21/225* (2013.01); *A63B 21/4047* (2015.10)

(58) Field of Classification Search
CPC ..... A63B 21/00072; A63B 21/153; A63B 21/225; A63B 21/4047; A63B 21/0628; A63B 21/4035; A63B 21/154; A63B 21/156; A63B 23/03541; A63B 23/12; A63B 23/03533; A63B 21/0442; A63B 21/151; A63B 21/4049; Y10T 403/32361
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |

(Continued)

OTHER PUBLICATIONS

Sailrite Youtube NPL (derived from: Sailrite, "Quick Pin—Stainless Steel Ball Detent Pin," Youtube, Posted Aug. 6, 2012 [ retrieved on Feb. 22, 2025], Retrieved from: https://www.youtube.com/watch?v=2BMudVZET_k) (Year: 2012).*

(Continued)

*Primary Examiner* — Loan B Jimenez
*Assistant Examiner* — Catrina A Letterman
(74) *Attorney, Agent, or Firm* — Holland & Hart LLP

(57) ABSTRACT

A cable-operated exercise device includes an adjustable arm. The adjustable arm includes an adjustment mechanism that is operable by a single hand. To adjust the vertical angular position of the arm, the user pulls a pin out of a positioning hole on an adjustment plate. The arm is counterbalanced about a pivot connection so that the position of the arm does not change when the pin is pulled out of the positioning hole. The user then moves the arm into a second position and puts the pin back into a second positioning hole.

4 Claims, 13 Drawing Sheets

(56) References Cited

U.S. PATENT DOCUMENTS

| | | | |
|---|---|---|---|
| 4,830,371 | A | 5/1989 | Lay |
| 4,844,451 | A | 7/1989 | Bersonnet et al. |
| 4,850,585 | A | 7/1989 | Dalebout et al. |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |
| 4,921,242 | A | 5/1990 | Watterson |
| 4,932,650 | A | 6/1990 | Bingham et al. |
| D309,167 | S | 7/1990 | Griffin |
| D309,485 | S | 7/1990 | Bingham et al. |
| 4,938,478 | A | 7/1990 | Lay |
| D310,253 | S | 8/1990 | Bersonnet et al. |
| 4,955,599 | A | 9/1990 | Bersonnet et al. |
| 4,971,316 | A | 11/1990 | Dalebout et al. |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout et al. |
| D315,765 | S | 3/1991 | Measom et al. |
| 4,998,725 | A | 3/1991 | Watterson et al. |
| 5,000,442 | A | 3/1991 | Dalebout et al. |
| 5,000,443 | A | 3/1991 | Dalebout et al. |
| 5,000,444 | A | 3/1991 | Dalebout et al. |
| D316,124 | S | 4/1991 | Dalebout et al. |
| 5,013,033 | A | 5/1991 | Watterson et al. |
| 5,014,980 | A | 5/1991 | Bersonnet et al. |
| 5,016,871 | A | 5/1991 | Dalebout et al. |
| D318,085 | S | 7/1991 | Jacobson et al. |
| D318,086 | S | 7/1991 | Bingham et al. |
| D318,699 | S | 7/1991 | Jacobson et al. |
| 5,029,801 | A | 7/1991 | Dalebout et al. |
| 5,034,576 | A | 7/1991 | Dalebout et al. |
| 5,058,881 | A | 10/1991 | Measom |
| 5,058,882 | A | 10/1991 | Dalebout et al. |
| D321,388 | S | 11/1991 | Dalebout |
| 5,062,626 | A | 11/1991 | Dalebout et al. |
| 5,062,627 | A | 11/1991 | Bingham |
| 5,062,632 | A | 11/1991 | Dalebout et al. |
| 5,062,633 | A | 11/1991 | Engel et al. |
| 5,067,710 | A | 11/1991 | Watterson et al. |
| 5,072,929 | A | 12/1991 | Peterson et al. |
| D323,009 | S | 1/1992 | Dalebout et al. |
| D323,198 | S | 1/1992 | Dalebout et al. |
| D323,199 | S | 1/1992 | Dalebout et al. |
| D323,863 | S | 2/1992 | Watterson |
| 5,088,729 | A | 2/1992 | Dalebout |
| 5,090,694 | A | 2/1992 | Pauls et al. |
| 5,102,380 | A | 4/1992 | Jacobson et al. |
| 5,104,120 | A | 4/1992 | Watterson et al. |
| 5,108,093 | A | 4/1992 | Watterson |
| D326,491 | S | 5/1992 | Dalebout |
| 5,122,105 | A | 6/1992 | Engel et al. |
| 5,135,216 | A | 8/1992 | Bingham et al. |
| 5,147,265 | A | 9/1992 | Pauls et al. |
| 5,149,084 | A | 9/1992 | Dalebout et al. |
| 5,149,312 | A | 9/1992 | Croft et al. |
| 5,171,196 | A | 12/1992 | Lynch |
| D332,347 | S | 1/1993 | Raadt et al. |
| 5,190,505 | A | 3/1993 | Dalebout et al. |
| 5,192,255 | A | 3/1993 | Dalebout et al. |
| 5,195,937 | A | 3/1993 | Engel et al. |
| 5,203,826 | A | 4/1993 | Dalebout |
| D335,511 | S | 5/1993 | Engel et al. |
| D335,905 | S | 5/1993 | Cutter et al. |
| D336,498 | S | 6/1993 | Engel et al. |
| 5,217,487 | A | 6/1993 | Engel et al. |
| D337,361 | S | 7/1993 | Engel et al. |
| D337,666 | S | 7/1993 | Peterson et al. |
| D337,799 | S | 7/1993 | Cutter et al. |
| 5,226,866 | A | 7/1993 | Engel et al. |
| 5,244,446 | A | 9/1993 | Engel et al. |
| 5,247,853 | A | 9/1993 | Dalebout |
| 5,259,611 | A | 11/1993 | Dalebout et al. |
| D342,106 | S | 12/1993 | Campbell et al. |
| 5,279,528 | A | 1/1994 | Dalebout et al. |
| D344,112 | S | 2/1994 | Smith |
| D344,557 | S | 2/1994 | Ashby |
| 5,282,776 | A | 2/1994 | Dalebout |
| 5,295,931 | A | 3/1994 | Dreibelbis et al. |
| 5,302,161 | A | 4/1994 | Loubert et al. |
| D347,251 | S | 5/1994 | Dreibelbis et al. |
| 5,316,534 | A | 5/1994 | Dalebout et al. |
| D348,493 | S | 7/1994 | Ashby |
| D348,494 | S | 7/1994 | Ashby |
| 5,328,164 | A | 7/1994 | Soga |
| D349,931 | S | 8/1994 | Bostic et al. |
| 5,336,142 | A | 8/1994 | Dalebout et al. |
| 5,344,376 | A | 9/1994 | Bostic et al. |
| D351,202 | S | 10/1994 | Bingham |
| D351,435 | S | 10/1994 | Peterson et al. |
| D351,633 | S | 10/1994 | Bingham |
| D352,534 | S | 11/1994 | Dreibelbis et al. |
| D353,422 | S | 12/1994 | Bostic et al. |
| 5,372,559 | A | 12/1994 | Dalebout et al. |
| 5,374,228 | A | 12/1994 | Buisman et al. |
| 5,382,221 | A | 1/1995 | Hsu et al. |
| 5,387,168 | A | 2/1995 | Bostic |
| 5,393,690 | A | 2/1995 | Fu et al. |
| D356,128 | S | 3/1995 | Smith et al. |
| 5,409,435 | A | 4/1995 | Daniels |
| 5,429,563 | A | 7/1995 | Engel et al. |
| 5,431,612 | A | 7/1995 | Holden |
| D360,915 | S | 8/1995 | Bostic et al. |
| 5,468,205 | A | 11/1995 | McFall et al. |
| 5,489,249 | A | 2/1996 | Brewer et al. |
| 5,492,517 | A | 2/1996 | Bostic et al. |
| D367,689 | S | 3/1996 | Wilkinson et al. |
| 5,511,740 | A | 4/1996 | Loubert et al. |
| 5,512,025 | A | 4/1996 | Dalebout et al. |
| D370,949 | S | 6/1996 | Furner |
| D371,176 | S | 6/1996 | Furner |
| 5,527,245 | A | 6/1996 | Dalebout et al. |
| 5,529,553 | A | 6/1996 | Finlayson |
| 5,540,429 | A | 7/1996 | Dalebout et al. |
| 5,549,533 | A | 8/1996 | Olson et al. |
| 5,554,085 | A | 9/1996 | Dalebout |
| 5,569,128 | A | 10/1996 | Dalebout |
| 5,591,105 | A | 1/1997 | Dalebout et al. |
| 5,591,106 | A | 1/1997 | Dalebout et al. |
| 5,595,556 | A | 1/1997 | Dalebout et al. |
| 5,607,375 | A | 3/1997 | Dalebout et al. |
| 5,611,539 | A | 3/1997 | Watterson et al. |
| 5,622,527 | A | 4/1997 | Watterson et al. |
| 5,626,538 | A | 5/1997 | Dalebout et al. |
| 5,626,542 | A | 5/1997 | Dalebout et al. |
| D380,024 | S | 6/1997 | Novak et al. |
| 5,637,059 | A | 6/1997 | Dalebout |
| D380,509 | S | 7/1997 | Wilkinson et al. |
| 5,643,153 | A | 7/1997 | Nylen et al. |
| 5,645,509 | A | 7/1997 | Brewer et al. |
| D384,118 | S | 9/1997 | Deblauw |
| 5,662,557 | A | 9/1997 | Watterson et al. |
| 5,669,857 | A | 9/1997 | Watterson et al. |
| 5,672,140 | A | 9/1997 | Watterson et al. |
| 5,674,156 | A | 10/1997 | Watterson et al. |
| 5,674,453 | A | 10/1997 | Watterson et al. |
| 5,676,624 | A | 10/1997 | Watterson et al. |
| 5,683,331 | A | 11/1997 | Dalebout |
| 5,683,332 | A | 11/1997 | Watterson et al. |
| D387,825 | S | 12/1997 | Fleck et al. |
| 5,695,433 | A | 12/1997 | Buisman |
| 5,695,434 | A | 12/1997 | Dalebout et al. |
| 5,695,435 | A | 12/1997 | Dalebout et al. |
| 5,702,325 | A | 12/1997 | Watterson et al. |
| 5,704,879 | A | 1/1998 | Watterson et al. |
| 5,718,657 | A | 2/1998 | Dalebout et al. |
| 5,720,200 | A | 2/1998 | Anderson et al. |
| 5,720,698 | A | 2/1998 | Dalebout et al. |
| D392,006 | S | 3/1998 | Dalebout et al. |

(56) References Cited

U.S. PATENT DOCUMENTS 5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 * 5/2001 Simonson ..... A63B 21/0628 482/102
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,443,877 B1 * 9/2002 Hoecht ..... A63B 23/035 482/138
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 * 1/2007 Simonson ..... A63B 21/156 482/138
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 * 10/2009 Gipson, III ..... A63B 21/156 482/138
7,604,573 B2 10/2009 Dalebout et al.
7,608,024 B2 10/2009 Sechrest et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby

(56) References Cited

U.S. PATENT DOCUMENTS 8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
10,398,920 B2 * 9/2019 Meredith ..... A63B 21/00072
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.

(56) References Cited

U.S. PATENT DOCUMENTS 10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
11,298,577 B2 4/2022 Watterson
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
2005/0124470 A1* 6/2005 Schopf ..... A63B 21/0617 482/99
2008/0051256 A1 2/2008 Ashby et al.
2015/0182780 A1* 7/2015 Olson ..... A63B 21/4029 482/92
2015/0251055 A1 9/2015 Ashby
2017/0124912 A1 5/2017 Ashby et al.
2017/0193578 A1 7/2017 Watterson
2017/0266481 A1* 9/2017 Dalebout ..... A63B 21/0552
2017/0266489 A1 9/2017 Douglass et al.
2017/0270820 A1 9/2017 Ashby et al.
2017/0319941 A1* 11/2017 Smith ..... A63B 24/0003
2018/0085630 A1 3/2018 Capell et al.
2018/0099116 A1 4/2018 Ashby
2018/0099180 A1 4/2018 Wilkinson
2018/0111034 A1 4/2018 Watterson
2019/0223612 A1 7/2019 Watterson et al.
2019/0269971 A1 9/2019 Capell et al.
2020/0009417 A1 1/2020 Dalebout
2020/0368575 A1 11/2020 Hays et al.
2020/0391069 A1 12/2020 Olson et al.
2021/0001177 A1 1/2021 Smith
2021/0046353 A1 2/2021 Dalebout et al.
2021/0106899 A1 4/2021 Willardson et al.
2021/0110910 A1 4/2021 Ostler et al.
2021/0146221 A1 5/2021 Dalebout et al.
2021/0213331 A1 7/2021 Watterson
2021/0268336 A1 9/2021 Watterson et al.
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2022/0062685 A1 3/2022 Ashby et al.
2022/0104992 A1 4/2022 Ashby
2022/0212052 A1 7/2022 Ercanbrack et al.
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 2/2023 Smith
2023/0122235 A1 4/2023 Ashby et al.
2023/0128721 A1 4/2023 Plummer
2023/0158358 A1 5/2023 Ercanbrack et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson

OTHER PUBLICATIONS

U.S. Appl. No. 17/066,485, filed Oct. 9, 2020, Weston et al.
U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.

(56) References Cited

OTHER PUBLICATIONS

U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.

* cited by examiner

ADJUSTABLE ARM ON AN EXERCISE DEVICE

CROSS-REFERENCE TO RELATED APPLICATIONS

This application claims priority to and the benefit of U.S. Provisional Patent Application No. 63/254,470, filed Oct. 11, 2021, which is incorporated by reference in its entirety.

BACKGROUND

Exercise devices are a popular way for people to exercise indoors, such as when weather, lifestyle, personal preferences, or other factors render exercising outdoors undesirable. Anaerobic exercises may be performed with free weights and/or exercise machines. In some embodiments, an exercise machine may be cable-operated. A cable-operated exercise machine may include one or more arms to position the handles used to operate the exercise machine. The angular position of the arms may be adjusted to change the position of the handles, thereby allowing the user to exercise different muscles or muscle groups.

BRIEF SUMMARY

In some embodiments, an exercise device includes a frame and a flywheel supported by the frame. A cable is connected to the flywheel, an extension of the cable is configured to rotate the flywheel. An arm connected to the frame includes a pulley system that routes the cable to the flywheel. A pivot connection between the arm and the frame adjusts an angular position of the arm about a pivot connection. A counterweight is connected to the arm at the pivot connection. The counterweight balances the arm about the pivot connection. An adjustment mechanism used to adjust the angular position of the arm includes an adjustment plate having a plurality of positioning holes. An adjustment pin is moveable between a closed position and an open position. In the closed position, the adjustment pin is inserted into one of the plurality of positioning holes. In the open position, the adjustment pin is prevented from moving into the closed position. In some embodiments, an adjustment dial may include a pin that is insertable into the positioning holes.

In some embodiments, a method for adjusting an angular position of an arm of an exercise device includes removing a pin of an adjustment mechanism from a first hole of an adjustment plate. The arm is counterbalanced such that, when the pin is removed, the arm remains in a first angular position. The method includes applying a torque to the arm to rotate the arm about a pivot connection from the first angular position to a second angular position. A pin is inserted into a second hole of the adjustment plate to secure the arm to the second angular position.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be clear from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 1-2 is a representation of a cable operated exercise device;

FIG. 2-1 and FIG. 2-2 are representations of an arm assembly in two different vertical angular positions, according to at least one embodiment of the present disclosure;

FIG. 3-1 and FIG. 3-2 are representations of an arm assembly with an adjustment mechanism in a locked and open position, according to at least one embodiment of the present disclosure;

FIG. 4-1 through FIG. 4-3 are representations of an adjustment mechanism, according to at least one embodiment of the present disclosure;

FIG. 6-1 and FIG. 6-2 are representations of an arm assembly with an adjustment dial in a locked and open position, according to at least one embodiment of the present disclosure.

DETAILED DESCRIPTION

This disclosure generally relates to devices, systems, and methods for single-handed adjustment of an arm of a cable operated exercise device. To change the arm position, a user may pull on a knob or dial to unlock a position change mechanism. The arm is counterbalanced about a pivot connection so that the arm retains its position until the user moves it into a new position. After the user moves the arm into a new position, the user may push on the knob or dial and lock the arm in the new position. Because the arm is counterbalanced about the pivot connection, the entire adjustment of the arm may be performed with a single hand, in at least one embodiment. This may increase the access and/or ease-of-use of the exercise device for all users, including individuals having disabilities that may prevent them from using the exercise device with two hands.

Figure 1:
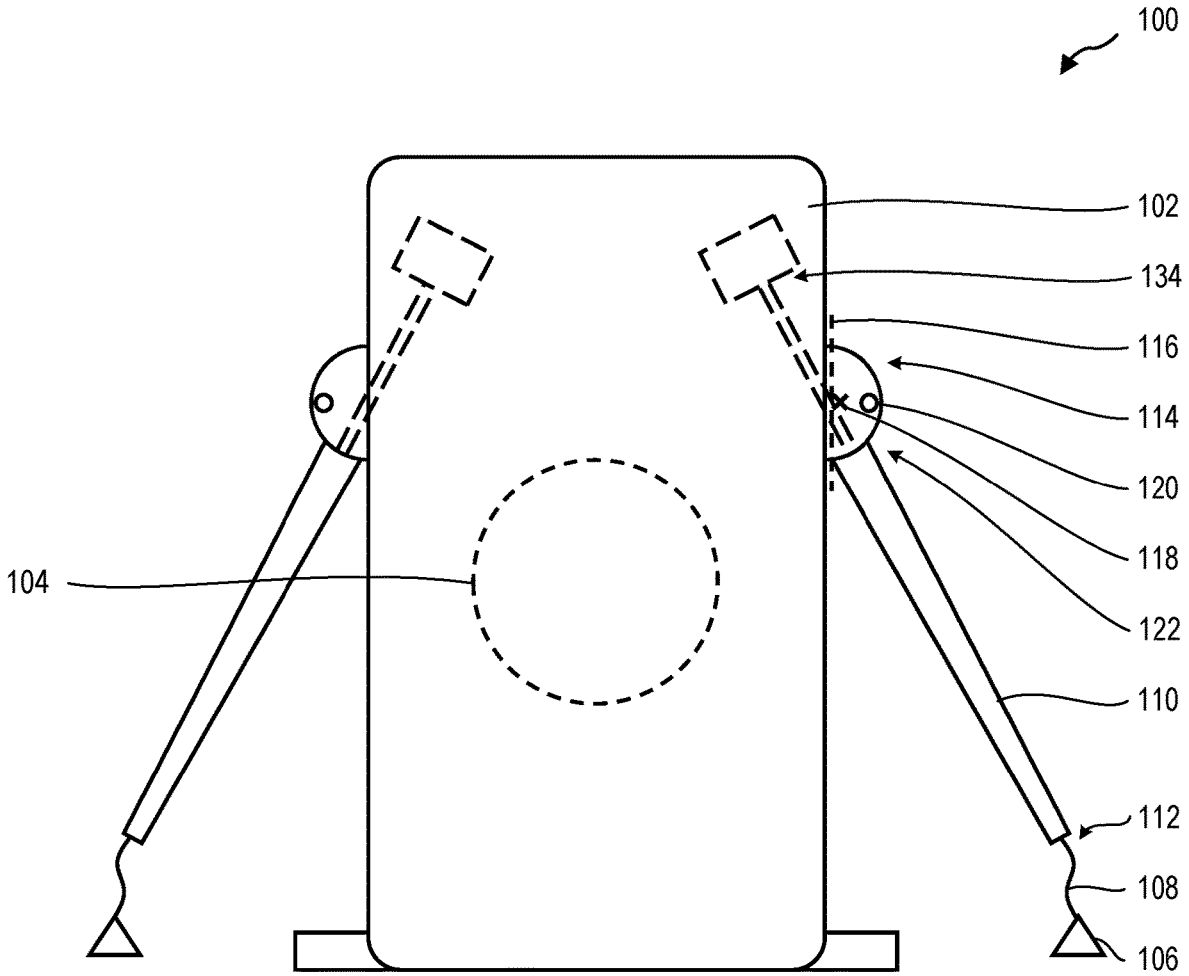
FIG. 1-1 is a representation of a cable operated exercise device, according to at least one embodiment of the present disclosure.

FIG. 1-1 is a representation of a cable operated exercise device 100, according to at least one embodiment of the present disclosure. The exercise device 100 includes a frame 102 and a flywheel 104 supported by the frame. A user may perform exercises by pulling on a handle 106 connected to a cable 108. The cable 108 may be connected to the flywheel 104 such that extending the cable 108 (e.g., by pulling the cable 108 with the handle 106) may rotate the flywheel 104. The flywheel 104 may include a retraction mechanism that may cause the cable 108 to be retracted. The retraction mechanism may include a ratcheting hub or freewheel hub that allows for the transfer of torque in a first rotational direction, but not in a second rotational direction. In some embodiments, the retraction mechanism may include a biasing element (such as a torsion spring) that may urge the cable 108 to move into a retracted position. In this manner, when the user extends the cable 108, the retraction mechanism may retract the cable 108, leaving the cable 108 available to be extended again.

The mass of the flywheel 104 may resist rotation when the cable 108 is extended. In this manner, a user may exercise one or more muscles by pulling on the handle 106 and the cable 108 in a particular motion. In some embodiments, the flywheel 104 may include a resistance mechanism that may impede rotation of the flywheel 104. The resistance mechanism may apply a force to the flywheel 104; a larger resistive force applied to the flywheel 104 may result in a larger force used by the user on the cable 108 to rotate the flywheel 104. The user may adjust or tailor the rotational resistance of the flywheel 104 to a desired resistance level, which may correspond to a desired level of force to extend the cable 108. In some embodiments, the level of resistance may be associated with a weight (e.g., 1 lb., 5 lb., 10 lb., 20 lb., 50 lb.), and the force used to extend the cable 108 may be the same as or similar to the force used to lift or move a free weight having the indicated weight. The resistance mechanism may be any type of resistance mechanism, such as a mechanical resistance mechanism (e.g., a brake), an electric resistance mechanism, a magnetic resistance mechanism, a fluid-based resistance mechanism, any other resistance mechanism, and combinations thereof.

During use, to exercise different muscles, the user may perform one or more exercise activities that involve extending the cable 108 by pushing or pulling on the handle 106. Different exercise activities may involve different motions by the user, including different motions that may involve different body positioning. In accordance with embodiments of the present disclosure, the exercise device 100 may include one or more arms 110. The arms 110 may be moved or rotated into different positions. The cable 108 may be routed through a pulley system in the arm 110 to the flywheel 104. When the retraction mechanism retracts the cable 108, the handle 106 may be pulled up against or close to a distal end 112 of the arm 110. The user may adjust the position of the arm 110 to place the distal end 112 in a desired location. This may allow the user to pull or push on the handle 106 from a particular height and/or angle, thereby enabling the user to exercise a particular muscle or group of muscles. In some embodiments, the exercise device 100 may include two arms 110, and the user may move both arms 110 into complementary positions to perform an exercise using both handles 106.

In some embodiments, the lateral position of the arm 110 may be adjusted. For example, the arm 110 may rotate about a lateral axis of rotation 116. This may cause the arm 110 to rotate into and out of the page. In some embodiments, the vertical position of the arm 110 may be adjusted about a pivot connection 114. The pivot connection 114 may have a vertical axis of rotation 118. By rotating the arm 110 about the lateral axis of rotation 116 and/or the vertical axis of rotation 118, the user may position the distal end 112 of the arm 110 at any desired location. In some embodiments, the arm 110 may be connected to the frame 102 with any type of connection, such as a hinge. In some embodiments the lateral position of the arm 110 may be changed independently of the vertical position of the arm. Put another way, the arm 110 may include a lateral adjustment mechanism and a separate vertical adjustment mechanism.

In some embodiments, the vertical angular position of the arm 110 may be maintained using a vertical adjustment mechanism 122. The adjustment mechanism 122 may be any type of adjustment mechanism used to adjust the angular position of the arm 110. In the embodiment shown, the adjustment mechanism 122 includes an adjustment pin 120 configured to be inserted into a hole of an adjustment plate. When the adjustment pin 120 is inserted into the adjustment plate, an interaction between the adjustment pin 120 and the hole in the adjustment plate may prevent the arm 110 from being moved vertically. When the adjustment pin 120 is removed from the hole, the arm 110 may be rotated about the vertical axis of rotation 118. In some embodiments, the adjustment pin 120 may be a cylinder with a spherical or partially spherical knob secured to the end of it.

In some situations, a user having a disability may desire to use the exercise device 100. For example, the user may have one hand or arm. Conventional exercise devices, however, may utilize two hands to change the position of the arm 110. For example, conventionally, a user may use a first hand to pull on adjustment pin 120, and while actively pulling on the adjustment pin 120, the user may change the position of the arm 110 with his or her second hand. Indeed, before pulling the adjustment pin 120, the user may support the arm 110 so that it does not fall down and injure the user. This may make adjustment by a person having a single arm or hand difficult, dangerous, and/or not feasible.

In accordance with embodiments of the present disclosure, the vertical and/or horizontal position of the arm 110 may be adjusted with a single hand from a single user. Put another way, the vertical and/or horizontal position of the arm 110 may be adjusted with a single user's single hand. For example, the arm 110 may be counterbalanced about the pivot connection (e.g., about the vertical axis of rotation 118) by a counterweight 134. In this manner, when the adjustment pin 120 is removed from the adjustment plate, the counterweight 134 may cause the arm 110 to maintain its vertical and/or horizontal position, and the arm 110 may not rotate about the pivot connection absent an outside force. This may allow the user to use a single hand to pull the adjustment pin 120 out of the adjustment plate and place the adjustment pin 120 in a locked open position, where the adjustment pin 120 remains out of the hole of the adjustment plate. The user may pull the adjustment pin 120 out of the adjustment plate without supporting the arm 110 and without the arm 110 changing position due to the counterbalancing of the counterweight 134. After placing the adjustment pin 120 in the locked open position, the user may remove his or her hand from adjustment pin 120 and use the hand to change the vertical angular position of the arm 110. When the user places the arm in the desired vertical angular position, the user may remove his or her hand from the arm 110 and insert the adjustment pin 120 into the adjustment plate. In this manner, the user may easily adjust the vertical angular position of the arm 110 with a single hand. This may help to improve the access and/or ease-of-use of the exercise device 100 for all users, including for people with disabilities, thereby improving the exercise experience. This may further help to improve the safety of the user while adjusting the position of the arm 110 by reducing the likelihood of inadvertent movement of the arm 110.

Figures 1, 2:
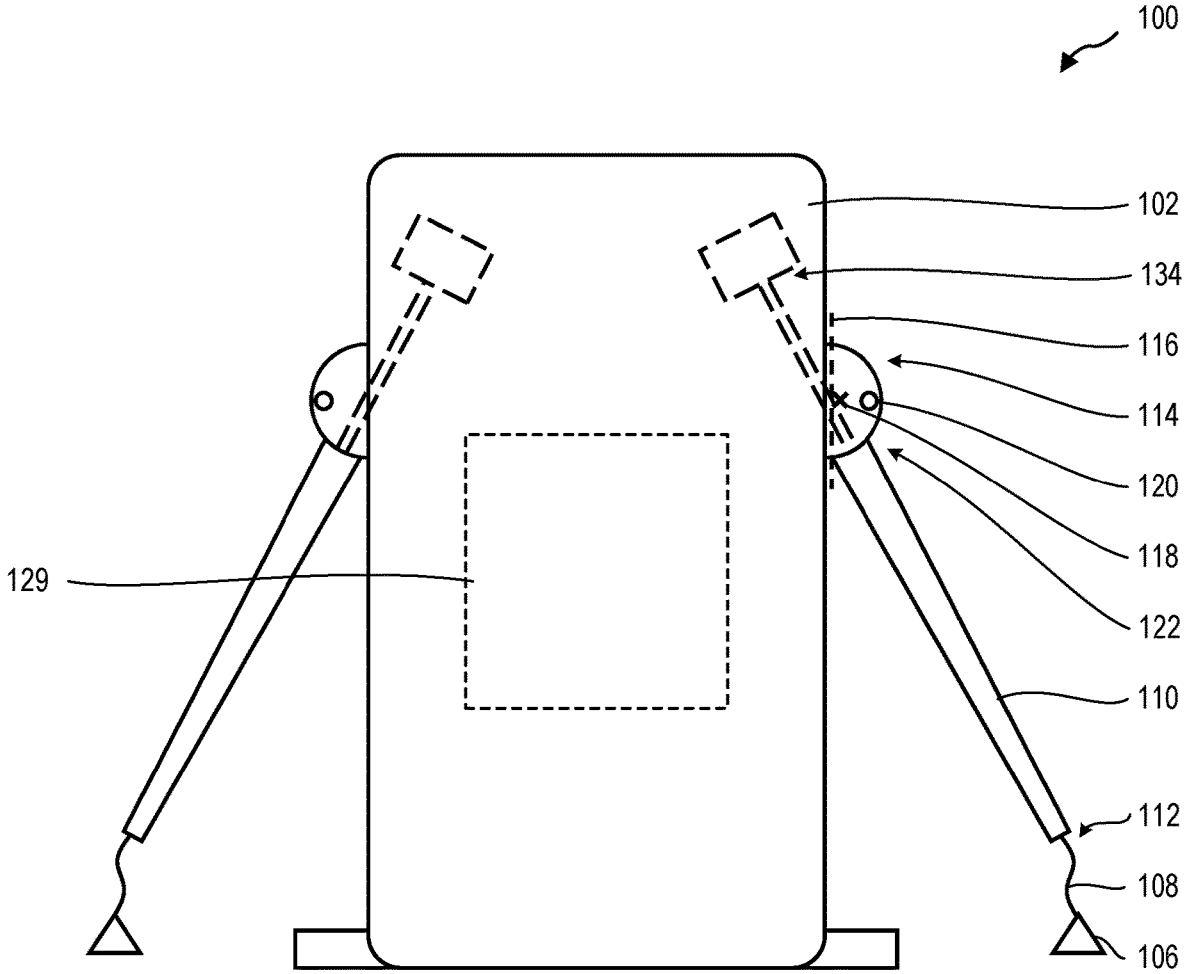
Figures 1, 2:
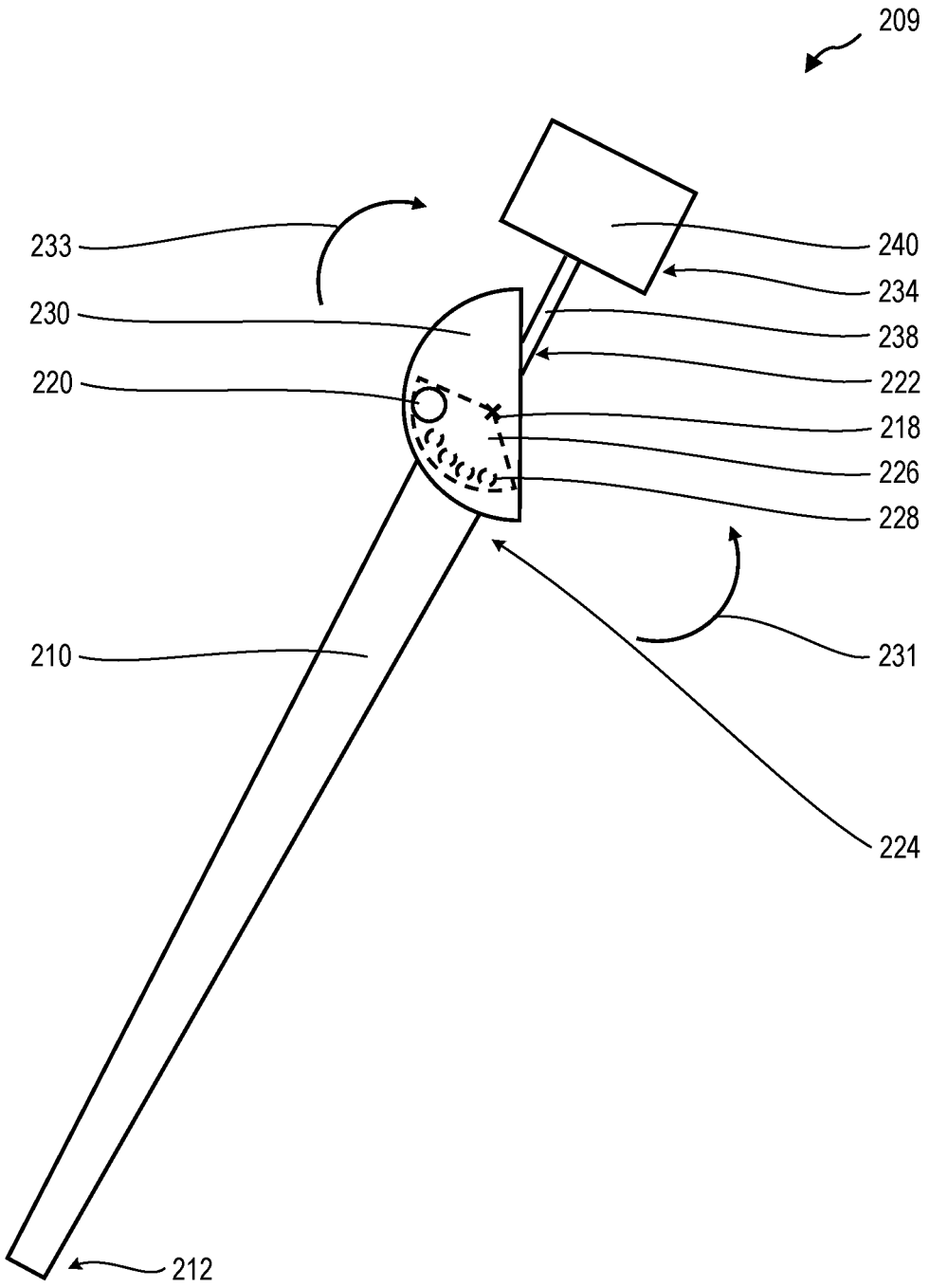
Figure 2:
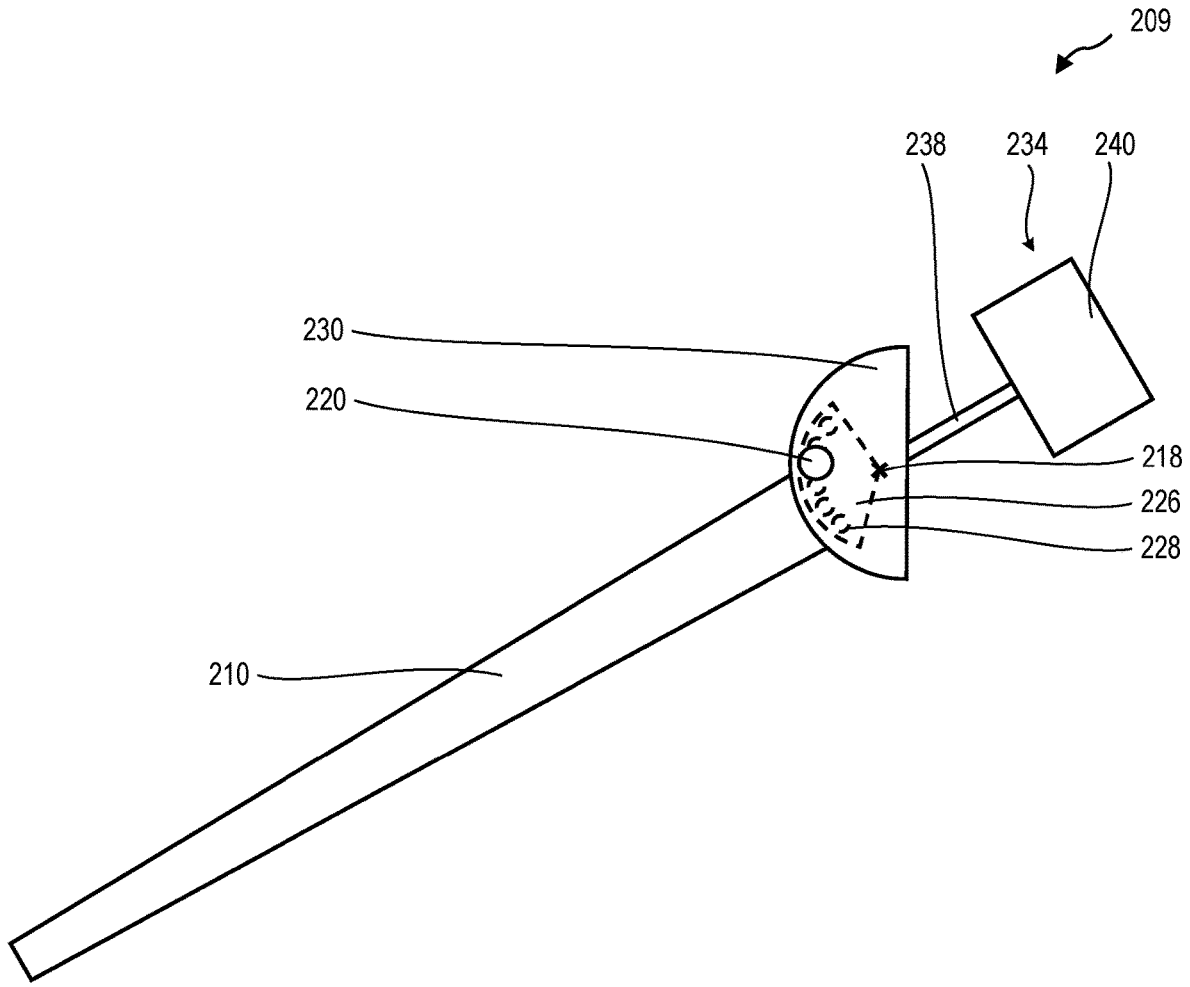

FIG. 1-2 is a representation of a cable operated exercise device 100 having a weight stack 129. During operation of the cable operated exercise device 100, the user may pull on the handle 106. This may extend the cable 108 through the arm 110. The cable 108 may be connected to one or more weights of the weight stack 129. During operation, as the handle 106 is extended, the cable 108 may pull on the one or more weights of the weight stack 129 and raise the weights of the weight stack 129. The weights in the weight stack 129 may cause resistance to extension of the handle 106 and the cable 108. In this manner, a user may perform exercise activities by pulling on the handle 106 and extending the cable 108.

In some embodiments, the amount of weight from the weight stack 129 connected to the cable 108 may be variable. For example, the weight stack 129 may include a plurality of weight plates. The user may adjust the number of weight plates that are connected to the cable 108, such as through a pin inserted through one or more of the weight plates and into to a bracket connected to an end of the cable 108. This may allow the user to vary the resistance to extension of the cable 108, thereby adjusting the intensity of an exercise activity.

In some embodiments, each of the cables 108 connected to the arms 110 may be connected to the weight stack 129. For example, both cables 108 may be connected to the arms 110, and the user may extend both handles 106 to raise and lower the weights from the weight stack 129. In some embodiments, each cable 108 may be connected to a different weight stack 129, thereby allowing the user to adjust the resistance to extension individually for each arm.

The user may adjust the position of the arm 110 to perform different exercises. In some embodiments, as discussed above with respect to FIG. 1-1, the arm 110 may be adjustable with a single hand. For example, the arm 110 may include a counterweight 134 to counterbalance the arm 110 about the rotation 118. In this manner, when the adjustment pin 120 is removed from the adjustment plate, the counterweight 134 may cause the arm 110 to maintain its vertical and/or horizontal position, and the arm 110 may not rotate about the pivot connection absent an outside force. This may allow the user to use a single hand to pull the adjustment pin 120 out of the adjustment plate and place the adjustment pin 120 in a locked open position, where the adjustment pin 120 remains out of the hole of the adjustment plate. The user may pull the adjustment pin 120 out of the adjustment plate without supporting the arm 110 and without the arm 110 changing position due to the counterbalancing of the counterweight 134. After placing the adjustment pin 120 in the locked open position, the user may remove his or her hand from adjustment pin 120 and use the hand to change the vertical angular position of the arm 110. When the user places the arm in the desired vertical angular position, the user may remove his or her hand from the arm 110 and insert the adjustment pin 120 into the adjustment plate. In this manner, the user may easily adjust the vertical angular position of the arm 110 with a single hand. This may help to improve the access and/or ease-of-use of the exercise device 100 for all users, including for people with disabilities, thereby improving the exercise experience. This may further help to improve the safety of the user while adjusting the position of the arm 110 by reducing the likelihood of inadvertent movement of the arm 110.

FIG. 2-1 is a front view of a representation of an arm assembly 209, according to at least one embodiment of the present disclosure. The arm assembly 209 may be configured to connect to the frame (e.g., the frame 102 of FIG. 1-1 or FIG. 1-2) of an exercise device (e.g., the cable operated exercise device 100 of FIG. 1-1 or FIG. 1-2). The arm assembly 209 includes an arm 210 having a proximal end 224 and a distal end 212. The proximal end 224 may be connected to an adjustment mechanism 222, which may allow the vertical angle of the arm 210 to be adjusted. The adjustment mechanism 222 may include an adjustment plate 226 (shown in dashed hidden lines). The adjustment plate 226 may be rigidly connected to the arm 210. Put another way, the adjustment plate 226 may rotate with the arm 210 as the arm 210 is rotated. In the embodiment shown, the arm 210 and the adjustment plate 226 may rotate about the vertical rotational axis 218.

The adjustment mechanism 222 may include a cover plate 230. The cover plate 230 may be placed over the adjustment plate 226. An adjustment pin 220 may extend through the cover plate 230 to the adjustment plate 226. The adjustment plate 226 may include one or more positioning holes 228. The adjustment pin 220 may extend into one of the positioning holes 228. When the adjustment pin 220 is located in the positioning hole 228, the contact of the adjustment pin 220 with the positioning hole 228 may prevent rotation of the arm 210.

To adjust the vertical angular position of the arm 210, the user may pull the adjustment pin 220 out of the positioning hole 228. In some embodiments, the user may pull the adjustment pin 220 in a direction parallel to the vertical rotational axis 218. This may remove the interference between the adjustment pin 220 and the positioning hole 228, thereby allowing the arm 210 to be moved or rotated. As discussed herein, the arm 210 may be counterbalanced about the vertical rotational axis 218 by a counterweight 234. The counterweight 234 may include a weight 240 connected to the arm 210 by an offset member (not shown) and an extension member 238. When the user pulls the adjustment pin 220 out of the positioning hole 228, the arm 210 may remain in the vertical rotational position shown in FIG. 2-1 due to the counterbalancing of the counterweight 234. The arm 210 may remain in this vertical rotation position until the user moves the arm 210.

To move the arm 210, the user may apply a torque to a pivot connection about the vertical rotational axis 218. This may cause the arm 210 to change the vertical angular position of the arm 210. For example, the user may apply a torque in a first direction 231. This may cause the arm 210 to rotate counter-clockwise in the view shown. In some examples, the user may apply a torque in a second direction 233. This may cause the arm 210 to rotate clockwise in the view shown.

In some embodiments, to change the vertical angular position of the arm 210 from the position shown in FIG. 2-1 to the position shown in FIG. 2-2, the user may apply a torque in the second direction 233. As may be seen, when rotating the arm 210 about the vertical rotational axis 218, the adjustment plate 226 may rotate about the vertical rotational axis 218. The cover plate 230 and the adjustment pin 220 may not rotate with the arm 210 (e.g., may remain stationary). The positioning holes 228 may move relative to the adjustment pin 220. The user may rotate the arm 210 and the adjustment plate 226 until a particular positioning hole 228 is aligned with the adjustment pin 220. The user may then push or insert the adjustment pin 220 into the positioning hole 228 to secure the arm 210 in a new vertical angular position. In some embodiments, the adjustment plate 226 may include any number of positioning holes. For example, the adjustment plate 226 may include 2, 3, 4, 5, 6, 7, 8, 9, 10, 11, 12, 13, 14, 15, or more positioning holes 228.

In accordance with embodiments of the present disclosure, to single-handedly adjust the angular position of the arm 210, the user may pull the adjustment pin 220 out of the positioning hole 228 on the adjustment plate 226, and the adjustment pin 220 may remain extended or removed from the positioning hole 228. When the adjustment pin 220 is out of the positioning hole 228, the arm 210 may maintain its angular position without support or force applied by the user due to the counterbalancing of the arm 210 by the counterweight 234. The user may then remove his or her hand from the adjustment pin 220 to move the arm 210. As discussed herein, the user may change the angular position of the arm 210 by applying a net torque to the arm assembly 209. When the user places the arm 210 in the desired angular position, the arm 210 may maintain the new angular position without support or force applied by the user due to the counterbalancing of the arm 210 by the counterweight 234. The user may then push the adjustment pin 220 back into the positioning hole 228. In this manner, a single user may use a single hand to adjust the angular position of the arm 210. This may improve the accessibility and/or ease-of-use of a connected exercise device for all users, including a person with a disability.

Figures 1, 3:
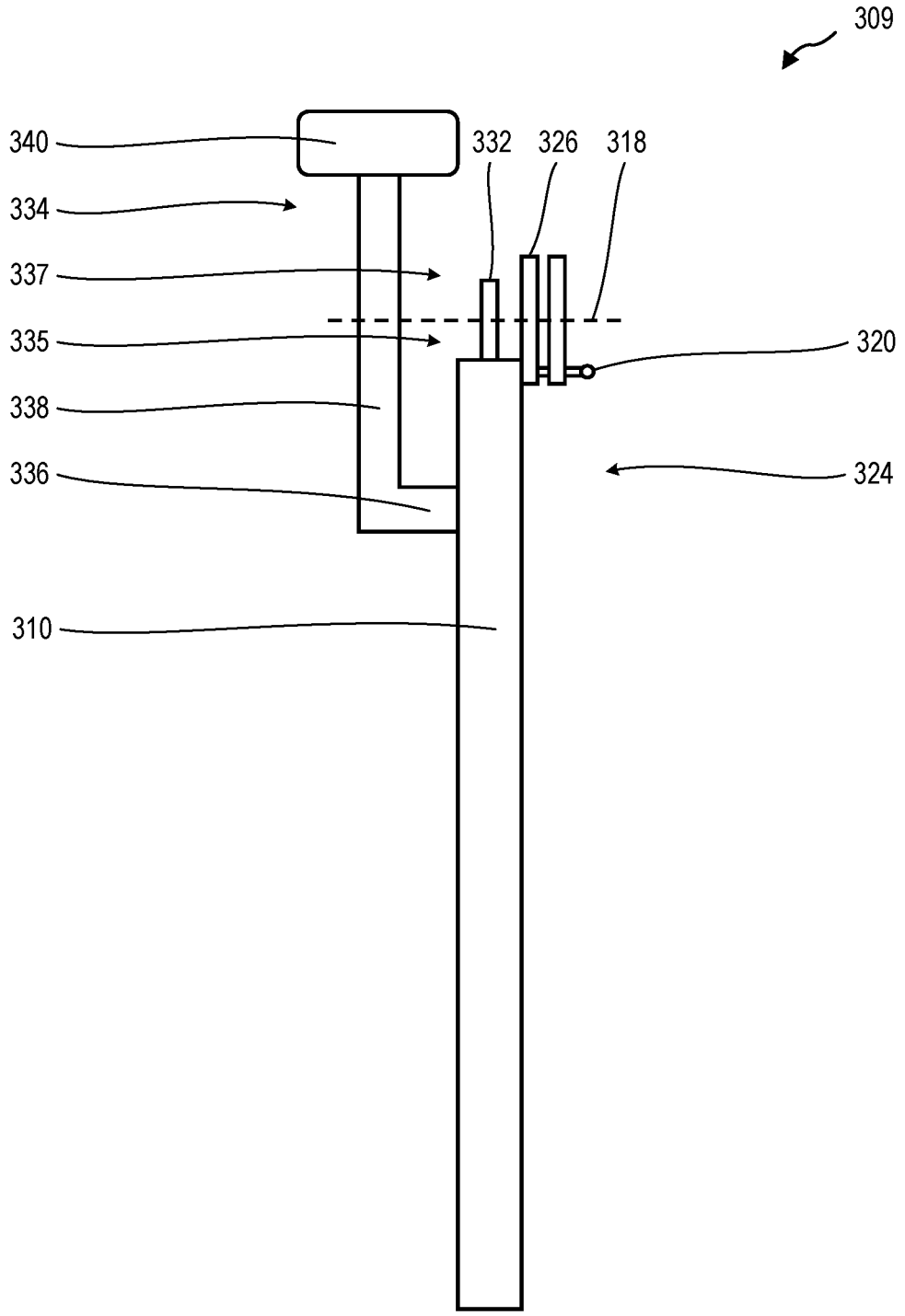
Figures 2, 3:
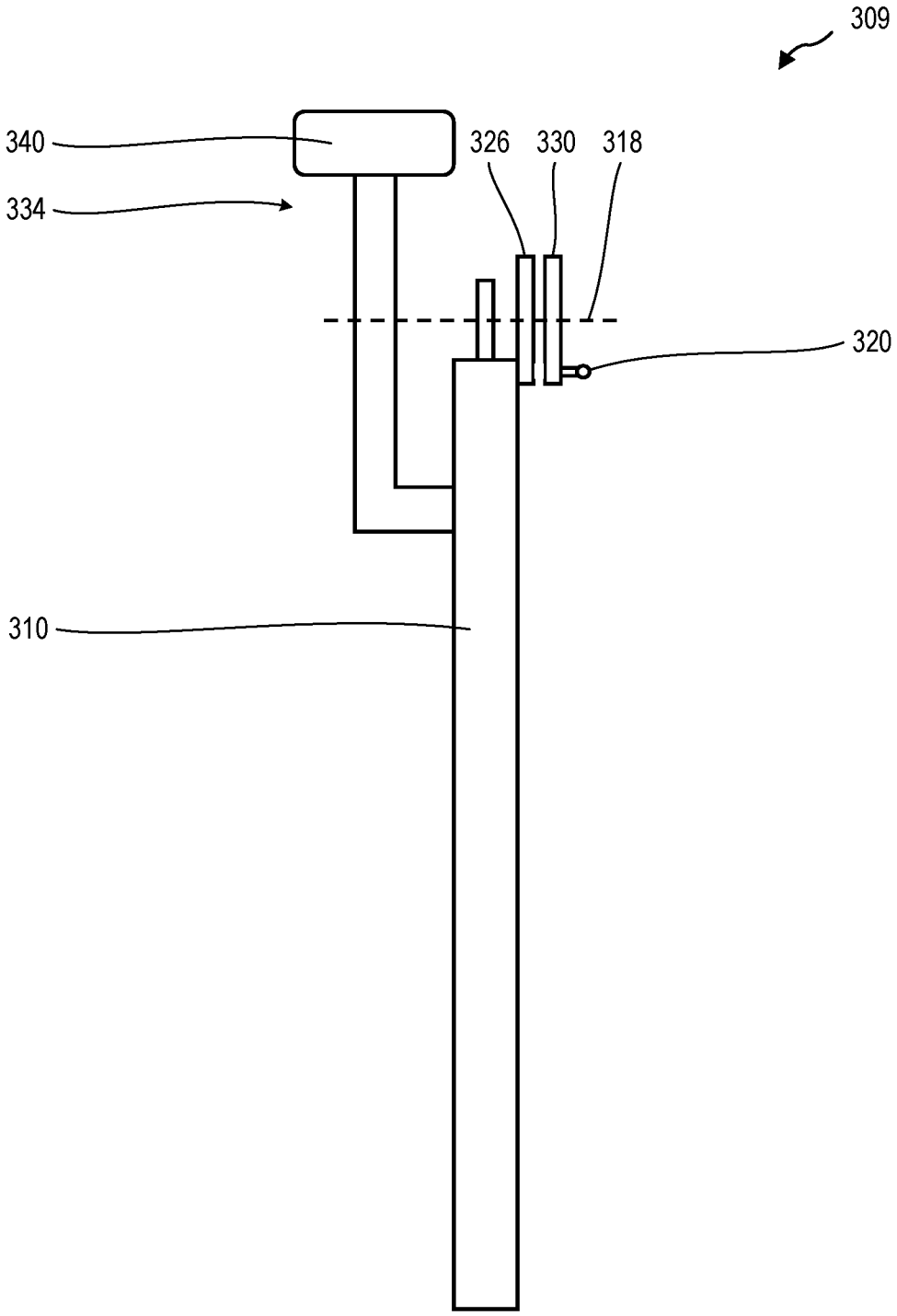

FIG. 3-1 is a representation of a top-down view of an arm assembly 309, according to at least one embodiment of the present disclosure. The arm assembly 309 includes an arm 310. The arm 310 may be connectable to a frame (e.g., the frame 102 of FIG. 1-1 or FIG. 1-2) of a cable operated exercise device (e.g., the cable operated exercise device 100 of FIG. 1-1 or FIG. 1-2) with a pivot connection 332. The pivot connection 332 may be any type of rotary connection, such as a hinge, a shaft in a cylinder, a bushing, a bearing, any other rotary connection, and combinations thereof. The arm 310 may rotate about a vertical rotational axis 318. An adjustment plate 326 may be rigidly connected to the arm 310 so that the adjustment plate 326 rotates about the vertical rotational axis 318. In the view shown in FIG. 3-1, an adjustment pin 320 is inserted into a positioning hole (e.g., positioning hole 228 of FIG. 2-1). This may lock the arm 310 in a vertical rotational position.

As discussed herein, the arm 310 may be counterbalanced about the vertical rotational axis 318. To counterbalance the arm 310, a counterweight 334 may be connected to a proximal end 324 of the arm 310. The counterweight 334 may be connected to the arm 310 on a first side 335 of the pivot connection 332. The arm 310 may be located on the first side 335 of the pivot connection. The counterweight 334 may extend past the arm to a second side 337 of the pivot connection 332, opposite the first side 335. The counterweight 334 may include an offset member 336, an extension member 338, and a weight 340. The offset member 336 may be connected to the arm 310 on the first side 335 of the pivot connection 332 and offset the extension member 338 and the weight 340 away from the arm 310 so that the extension member and/or the weight 340 do not contact the arm 310 or interfere with its operation. The extension member 338 may extend parallel or approximately parallel to the arm 310 toward the vertical rotational axis 318 and/or the pivot connection 332. The extension member 338 may extend past the vertical rotational axis 318 and/or the pivot connection 332 to the second side 337 of the pivot connection 332. The weight 340 may be connected to the extension member 338 on the second side 337 of the pivot connection 332. The weight 340 may be located opposite the arm 310 about the pivot connection 332 and/or the vertical rotational axis 318.

In accordance with embodiments of the present disclosure, the counterweight 334 may balance the rotational forces on the arm 310 about the pivot connection 332 and/or the vertical rotational axis 318. For example, the arm 310 has a mass, the weight of which applies a torque in a first direction (e.g., the first direction 231 of FIG. 2-1) to the pivot connection 332 based on the force of gravity. Absent an outside force, the weight of the arm 310 may cause the arm 310 to rotate about the pivot connection 332 when the adjustment pin 320 is removed from the adjustment plate 326. This may make adjustment of the vertical position of the arm 310 difficult to perform single-handedly. The counterweight 334 may be configured to counteract or balance out the torque on the pivot connection 332 caused by the arm 310.

To counteract the torque on the pivot connection, the counterweight 334 has a weight 340. The weight 340 has a mass, the weight of which applies a torque in a second direction (e.g., the second direction 233 of FIG. 2-2) to the pivot connection 332 based on the force of gravity. In accordance with embodiments of the present disclosure, the mass of the weight 340 may be selected to apply an equal or approximately equal torque to the pivot connection 332 as the arm 310. This may result in a net zero torque on the pivot connection 332. In this manner, when the adjustment pin 320 is removed from the adjustment plate 326, the vertical angular position of the arm 310 may not change. This may improve the ease of use and/or adjustment of the vertical angular position of the arm 310.

In some embodiments, the counterweight 334 may only be connected to the exercise device (e.g., the cable operated exercise device 100 of FIG. 1-1 or FIG. 1-2) at the pivot connection 332. Put another way, the counterweight 334 may not have any pistons, gas cylinders, cables, or other elements that are connected to both the counterweight 334 and the frame of the exercise device. In some embodiments, the arm 310 may only be connected to the exercise device at the pivot connection 332. Put another way, the arm 310 may not have any pistons, gas cylinders, cables, or other elements that are connected to both the arm 310 and the frame of the exercise device. In some embodiments, the only element that is connected to the arm 310 to make adjusting the angular position of the arm 310 easier may be the counterweight 334.

The arm assembly 309 has a net torque. The net torque may be the sum of the torque applied by the arm 310 and the torque applied by the counterweight 334. In some embodiments, the net torque may be equal to zero. Put another way, the arm assembly 309 may have zero or no net torque. A zero net torque may be any net torque applied to the pivot connection 332 that is insufficient to cause the arm 310 to change angular position. In some embodiments, one of the torques applied by the arm or the torque applied by the counterweight 334 may be greater than the other, while still resulting in a net torque of zero because the net torque is too small to move the arm 310 (e.g., move the combined mass of the arm 310 and counterweight 334, overcome the friction forces on the pivot connection 332).

In some embodiments, the weight 340 may be positioned opposite the arm 310 across the pivot connection 332. In some embodiments, the weight 340 may be positioned diametrically opposite (e.g., 180 degrees across from) the arm 310 about the pivot connection 332. In some embodiments, the mass of the weight 340 may be the same as the mass of the arm 310. In some embodiments, the mass of the weight 340 may be different from the mass of the arm 310. In some embodiments, the center of mass of the weight 340 may be located the same distance from the vertical rotational axis 318 as the center of mass of the arm 310. In some embodiments, the center of mass of the weight 340 may be located a different distance away from the vertical rotational axis 318 as the center of mass of the arm 310.

As discussed herein, to change the vertical angular position of the arm 310, the user may pull the adjustment pin 320 out of the adjustment plate 326 to the position shown in FIG. 3-2. The user may then apply a torque to the arm assembly 309. Because the arm 310 is counterbalanced about the pivot connection 332, the applied torque may be sufficient to rotate the mass and overcome friction in the pivot connection 332. In some embodiments, the applied torque may be in a range having an upper value, a lower value, or upper and lower values including any of 0.1 Nm, 0.5 Nm, 1 Nm, 1.5 Nm, 2.0 Nm, 2.5 Nm, 3.0 Nm, 4 Nm, 5 Nm, 6 Nm, 7 Nm, 8 Nm, 9 Nm, 10 Nm, 20 Nm, 30 Nm, 40 Nm, 50 Nm, or any value therebetween. For example, the applied torque may be greater than 0.1 Nm. In another example, the applied torque may be less than 50 Nm. In yet other examples, the applied torque may be any value in a range between 0.1 Nm and 50 Nm. In some embodiments, it may be critical that the applied torque is less than 20 Nm to allow the user to change the vertical position of the arm 310 with a single hand.

In the position shown in FIG. 3-1, the adjustment pin 320 is in a closed position, where the adjustment pin 320 is inserted into one of the positioning holes. In the position shown in FIG. 3-2, the adjustment pin 320 is in an open position, where the adjustment pin 320 is removed from all of the positioning holes. In some embodiments, the adjustment pin 320 may move parallel to the vertical rotational axis 318. The adjustment pin 320 may be held in place and/or guided by a cover plate 330. The adjustment pin 320 and the cover plate 330 may be stationary relative to the arm 310 and the adjustment plate 326. Put another way, the arm 310 and the adjustment plate 326 may be rotatable relative to the cover plate 330 and the adjustment pin 320. To adjust the position of the arm 310, when the adjustment pin 320 is removed from the adjustment plate 326, the arm 310 and the adjustment plate 326 may be moved relative to the cover plate 330 until the desired positioning hole is aligned with the adjustment pin 320. To lock the arm in place, the user may insert the adjustment pin 320 into the positioning hole.

In some embodiments, the adjustment pin 320 may be biased toward the closed position. For example, the cover plate 330 may include one or more biasing elements that urge the adjustment pin 320 toward the adjustment plate. To remove the adjustment pin 320, the user may pull on the adjustment pin 320, overcoming the biasing force, until the adjustment pin 320 is removed from the positioning hole. In some embodiments, when the user lets go of the adjustment pin 320 (e.g., when the force the user is applying to the adjustment pin 320 no longer overcomes the biasing force), the biasing element may move the adjustment pin 320 toward the adjustment plate 326. This may help to prevent inadvertent removal of the adjustment pin 320 from the adjustment plate 326, and therefore inadvertent movement of the arm 310 during use.

In some embodiments, to allow for single-handed adjustment of the vertical angular position of the arm 310, the cover plate 330 may include a locking mechanism. The locking mechanism may lock the adjustment pin 320 in the open position. This may allow the user to let go of the adjustment pin 320 and change the position of the arm 310. In some embodiments, the locking mechanism may be actively engaged and disengaged. For example, to engage the locking mechanism, the user may rotate the adjustment pin 320 (see FIG. 4-1 through FIG. 4-3 and the associated description). This may further help to prevent inadvertent insertion of the adjustment pin 320 into a positioning hole.

In some embodiments, the locking mechanism may be automatically engaged. For example, the locking mechanism may include an index and pin mechanism. A cylinder may include an indexing track and the adjustment pin 320 may include an indexing pin. Pulling the adjustment pin 320 may cause the indexing pin to engage the indexing track, rotating the cylinder. The indexing track may include a locked-open position, where the indexing pin may rest in a saddle or trough in the indexing track. When the arm 310 is in the desired position, the user may pull on the adjustment pin 320, contacting the indexing track and rotating the cylinder so that when the user releases the adjustment pin, the indexing pin rests in a closed position on the cylinder.

Figures 1, 4:
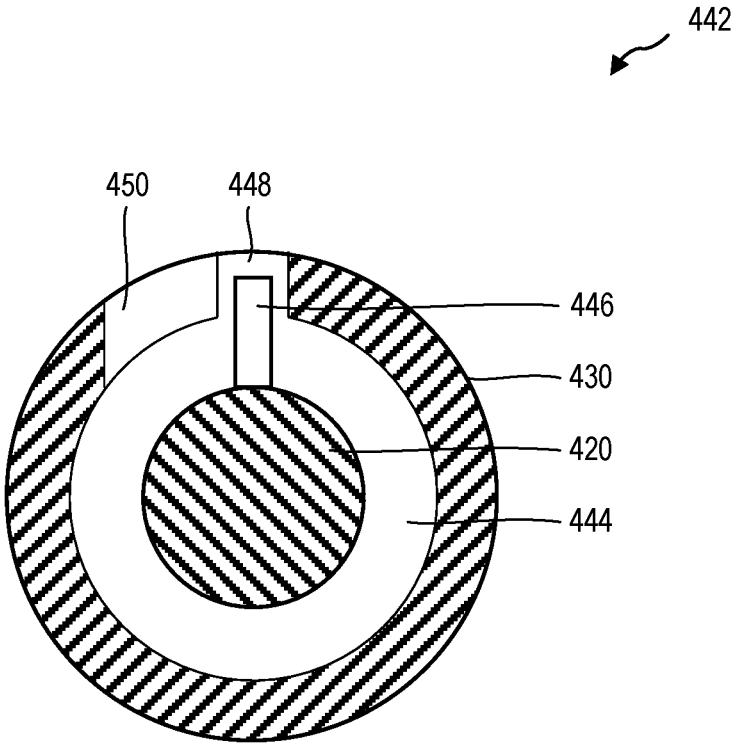
Figures 2, 4:
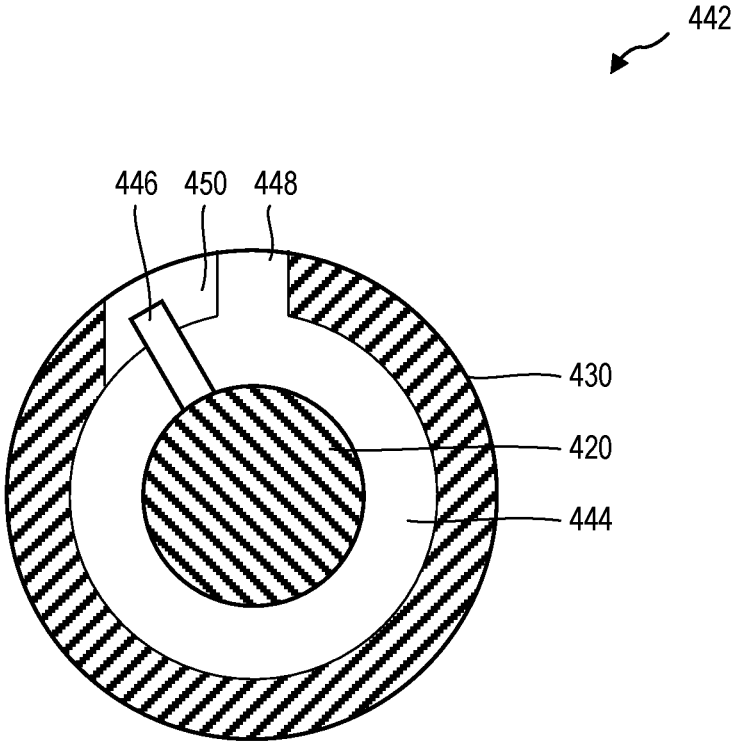
Figures 3, 4:
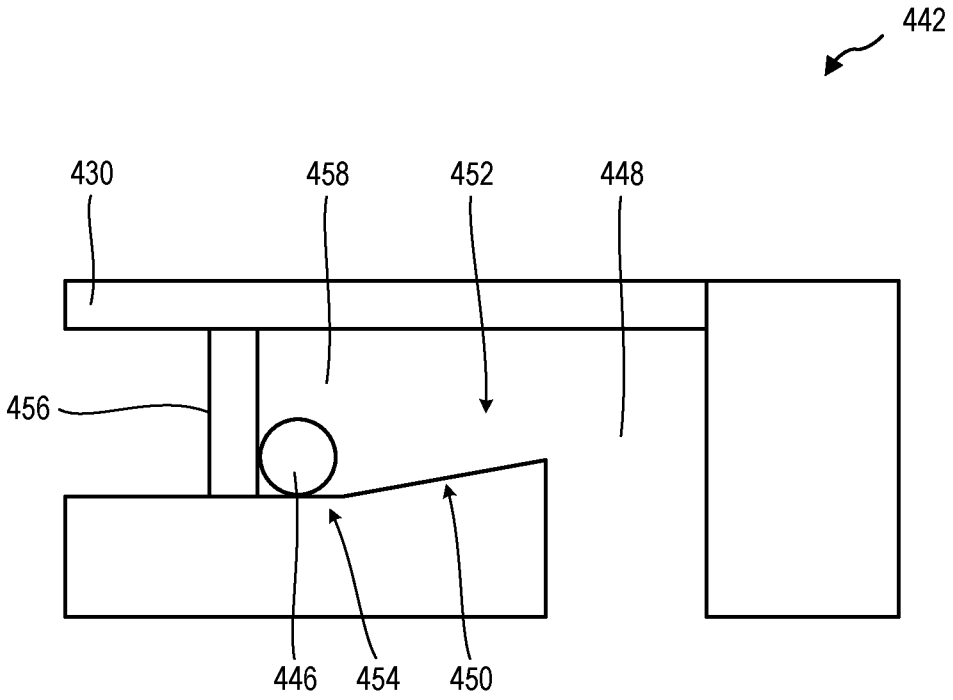

FIG. 4-1 is a cross sectional view of a locking mechanism 442, according to at least one embodiment of the present disclosure. The locking mechanism 442 may be connected to an integral portion of the cover plate 430. The cover plate 430 includes a bore 444 through which an adjustment pin 420 is inserted. The adjustment pin 420 includes a protrusion 446 extending from an outer surface of the adjustment pin 420. The protrusion 446 may include a bar, a pin, a bead, or any other element extending from the adjustment pin 420.

The cover plate 430 includes a notch 448. When the protrusion 446 is aligned with the notch 448, the adjustment pin 420 may move in and out of the bore 444 (e.g., into and out of the page). In the closed position, the protrusion 446 may be located in the notch 448 between two sides of the cover plate 430. When the user pulls the adjustment pin 420 from the closed position to the open position, the protrusion 446 may extend past a ledge 450 on the cover plate 430. The user may then rotate the adjustment pin 420 so that the protrusion 446 is oriented over the ledge 450.

In the view shown in FIG. 4-2, the adjustment pin 420 and the protrusion 446 have been rotated until the adjustment pin 420 is located over the ledge 450. When the user releases the adjustment pin 420, the protrusion 446 may rest on the ledge 450. This may place the adjustment pin 420 in the single-hand open position. In the single-hand open position, the adjustment pin 420 may engage or contact the ledge 450, which may prevent the adjustment pin 420 from moving into the closed position. Put another way, the ledge 450 prevents the adjustment pin 420 from moving into the closed position from the single-hand open position. This may allow the user to release the adjustment pin 420 and move the arm with the same hand. The user may then release the arm and move the adjustment pin 420 back into the closed position This may improve the ease-of-use and/or the accessibility of the adjustment mechanism of the cable operated exercise device.

FIG. 4-3 is a side cross-sectional view of the locking mechanism 442 of FIG. 4-1 and FIG. 4-2 in the locked position. In the view shown, the adjustment pin 420 and the protrusion 446 have been rotated so that the protrusion 446 is oriented over and resting on the ledge 450. As discussed herein, this may prevent the adjustment pin 420 from being inserted into a positioning hole. In some embodiments, the ledge 450 may include a ramp 452. The ramp 452 may be angled away from the notch 448. This may help to place the protrusion 446 in a saddle 454 on the ledge 450. The ramp 452 may further help to prevent inadvertent movement of the protrusion 446 into the notch 448.

In some embodiments, the ledge 450 may include a stop 456. The stop may help to prevent the protrusion 446 from extending too far into a cavity 458 of the cover plate 430. In some embodiments, to move the adjustment pin 420 from the single-hand open position to the closed position, the user may simply rotate the adjustment pin 420. As the adjustment pin 420 is rotated, the protrusion 446 may be urged up the ramp 452. When the protrusion reaches the notch 448, a biasing element may urge the adjustment pin 420 into a positioning hole in the adjustment plate. In some embodiments, the slope of the ramp 452 may be shallow enough to allow the user to rotate the adjustment pin 420 without pulling on it. This may make it easy to return the adjustment pin 420 back into the locked position with a single motion or a single hand. This may improve the accessibility and/or the ease-of-use of adjusting the vertical angular position of the arm for all users, including a person with a disability.

Figure 5:
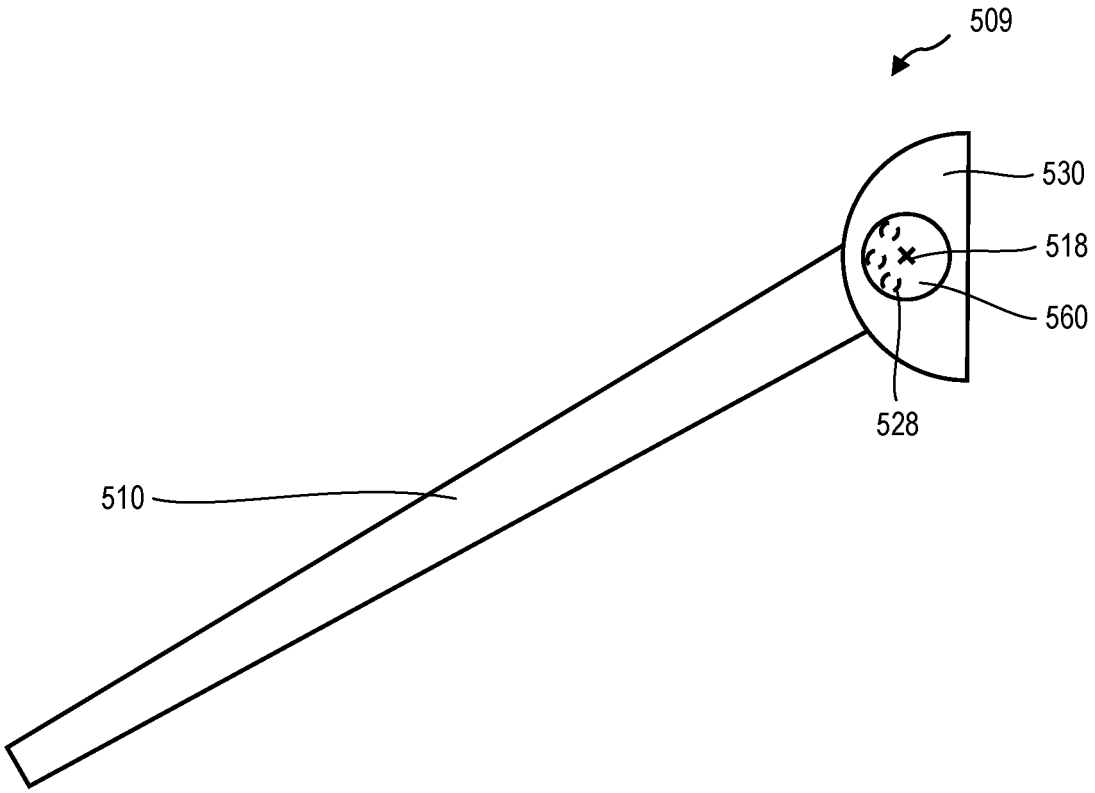
FIG. 5 is a representation of a side view of an arm assembly including an adjustment dial, according to at least one embodiment of the present disclosure.

FIG. 5 is a representation of a side view of an arm assembly 509 having an adjustment dial 560 that is used to adjust the vertical angular position of the arm 510. The adjustment dial 560 may be coaxial with a vertical rotation axis 518 of the arm 510. The adjustment dial 560 may be rotationally fixed to the arm 510. To rotate the arm 510, the user may rotate the adjustment dial 560. The cover plate 530 may include one or more positioning holes 528. The adjustment dial 560 may include an adjustment pin that may be inserted into the positioning holes 528. To change the vertical angular position of the arm 510, the user may pull on the adjustment dial 560 (e.g., out of the page) until the adjustment pin has been removed from the positioning hole 528. The user may then rotate the adjustment dial 560, thereby rotating the arm 510.

When the arm 510 is in the desired vertical angular position, the user may push on the adjustment dial 560 (e.g., into the page) until the adjustment pin has been inserted into a positioning hole 528 associated with the desired position of the arm 510. In some embodiments, the adjustment dial 560 may be biased toward the cover plate 530, and the user may release the adjustment dial 560 to return it to the locked position. Using the adjustment dial 560 to adjust the position of the arm 510 may allow a single user to adjust the position of the arm 510 with a single hand. In some embodiments, the user may adjust the position of the arm 510 without removing his or her hand from the adjustment dial 560. This may help to improve the ease-of-use and/or accessibility of adjusting the vertical angular position of the arm for all users, including a person with a disability.

Figures 1, 6:
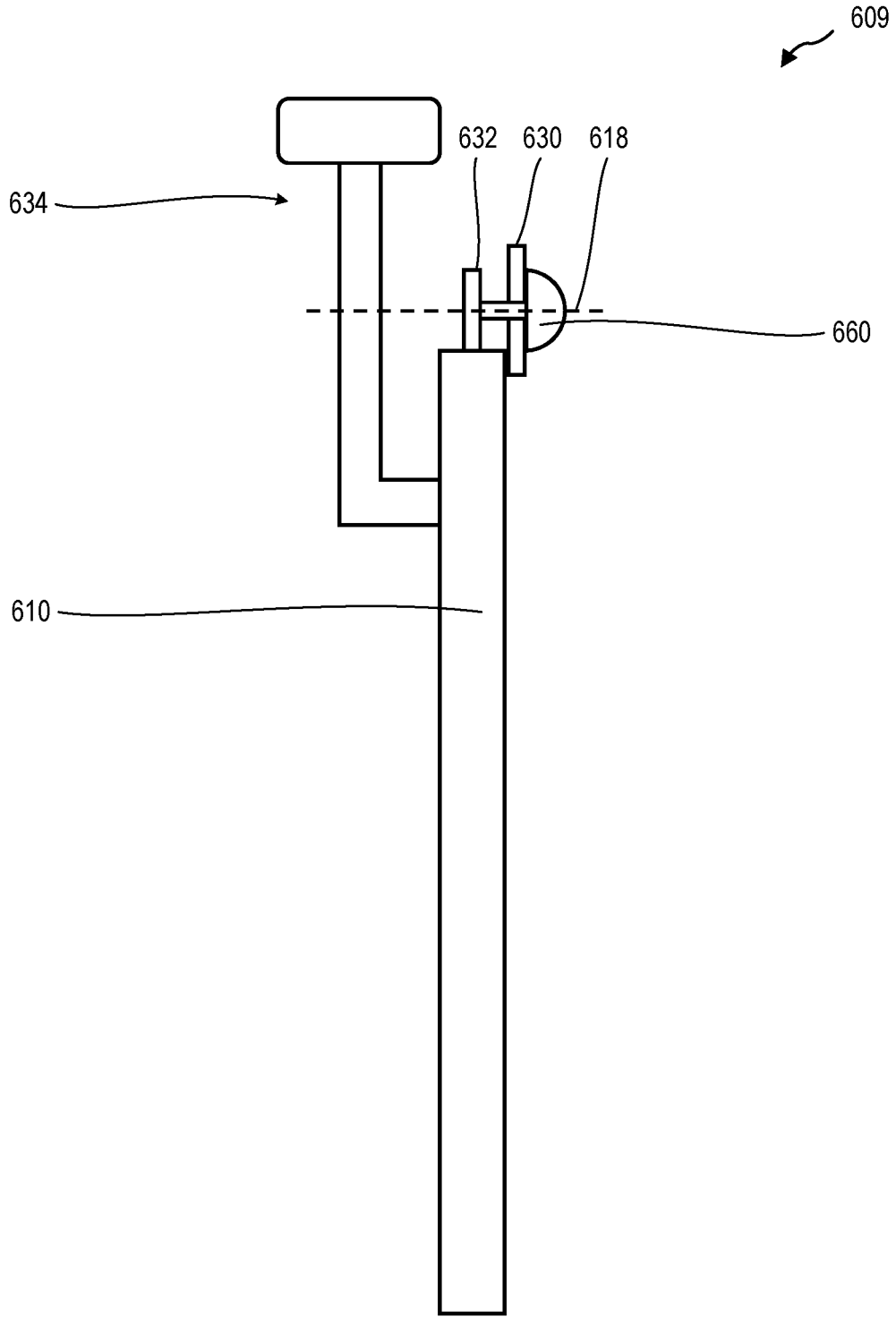
Figures 2, 6:
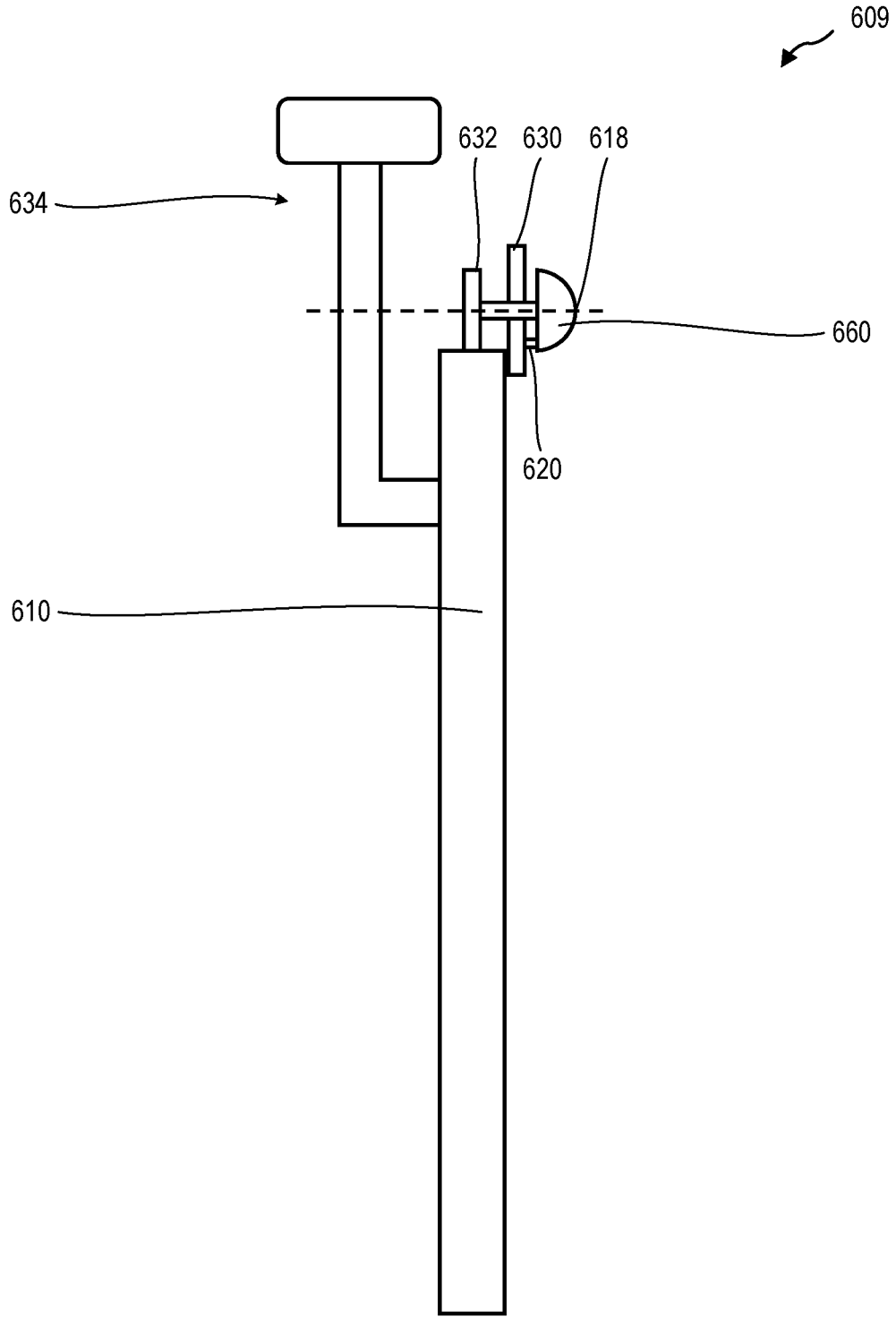

FIG. 6-1 is a representation of a top-down view of an arm assembly 609, according to at least one embodiment of the present disclosure. The arm assembly 609 includes an arm 610. The arm 610 may be connectable to a frame (e.g., the frame 102 of FIG. 1-1 or FIG. 1-2) of a cable operated exercise device (e.g., the cable operated exercise device 100 of FIG. 1-1 or FIG. 1-2) with a pivot connection 632. The arm 610 may rotate about a vertical rotational axis 618.

An adjustment dial 660 may be connected to the arm at the pivot connection 632. In some embodiments, the adjustment dial 660 may be rotationally fixed to the arm 610. Put another way, the adjustment dial 660 may be connected to the arm 610 such that rotating the adjustment dial 660 may rotate the arm 610. In some embodiments, the adjustment dial 660 may be coaxial with the pivot connection 632. In some embodiments, the adjustment dial 660 may be coaxial with the vertical rotational axis 618. The arm assembly 609 may further include a cover plate 630. In some embodiments, the cover plate 630 may include one or more positioning holes. When the adjustment dial 660 is located in the locked position shown in FIG. 6-1, an adjustment pin connected to the adjustment dial may be inserted into a positioning hole on the cover plate 630. Thus, in some embodiments, the cover plate 630 may be considered an adjustment plate. The arm 610 and the adjustment dial 660 may be rotatable relative to the cover plate 630.

To change the vertical rotational position, the user may pull on the adjustment dial 660 to pull the adjustment pin 620 out of the positioning hole into the open position shown in FIG. 6-2. As may be seen, in the open position, the adjustment pin 620 may be pulled out of the cover plate 630. To change the vertical angular position of the arm 610, the user may apply a torque to the adjustment dial 660. When the arm 610 is in the desired vertical angular position, the user may push the adjustment dial 660 in toward the cover plate 630, which may insert the adjustment pin 620 into a positioning hole in the cover plate 630. This may move the adjustment dial back into the locked position shown in FIG. 6-1.

As discussed herein, the arm assembly 609 may be counterbalanced about the pivot connection 632 and/or the vertical rotational axis 618 with a counterweight 634. This may allow a single user to adjust the position of the arm 610 by rotating the adjustment dial 660 with a single hand (e.g., without a supporting hand on the arm 610 or any other portion of the arm assembly 609). By using an adjustment dial 660, the user may pull the adjustment dial 660 out, rotate the adjustment dial until the arm 610 is in the desired position, and push the adjustment dial 660 back into the locked position in a single continuous action, without taking his or her hand off of the adjustment dial 660. This may allow for easy adjustment of the arm 610, thereby improving the accessibility of the exercise device for all users, including a person with a disability.

While embodiments of the present disclosure have discussed an adjustment pin 620 that is connected to the adjustment dial 660, and positioning holes located in the cover plate 630, it should be understood that other configurations may be contemplated. For example, the adjustment pin 620 may be fixed to the cover plate 630, and the adjustment dial 660 may include a plurality of positioning holes. Pulling the adjustment dial 660 away from the cover plate 630 may remove the adjustment pin 620 from the current adjustment hole in the adjustment dial 660. And pushing the adjustment dial toward the cover plate 630 may push the adjustment pin 620 into the new adjustment hole in the adjustment dial 660.

While embodiments of the present disclosure have illustrated and discussed the adjustment dial 660 rotationally connected directly to the pivot connection 632 along the vertical rotational axis 618, it should be understood that the adjustment dial 660 may be otherwise connected or rotationally fixed to the arm assembly 609. For example, the adjustment dial 660 may include a tab, support, or other member that extends below the adjustment dial 660 and connects to the body of the arm 610. This may help to increase the strength of the connection between the adjustment dial 660 and the arm 610.

Figure 7:
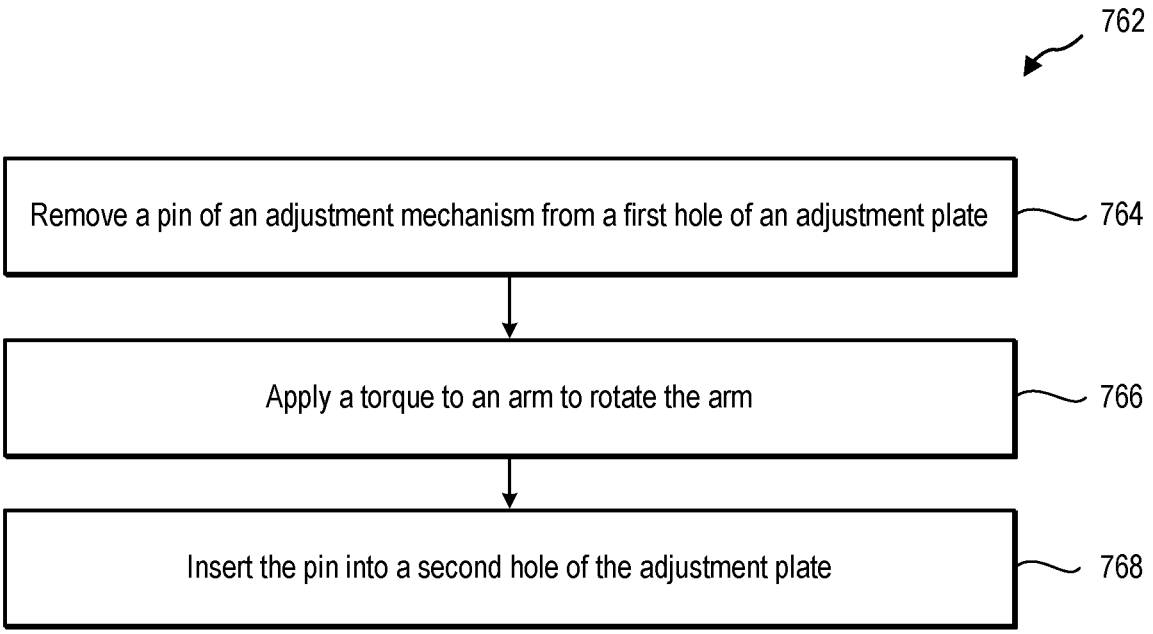
FIG. 7 is a representation of a method for adjusting an angular position of an arm of an exercise device, according to at least one embodiment of the present disclosure.

FIG. 7 is a representation of a method 762 for adjusting an angular position of an arm of an exercise device, according to at least one embodiment of the present disclosure. The method 762 includes removing a pin of an adjustment mechanism from a first hole of an adjustment plate at 764. The arm may be counterbalanced such that, when the pin is removed, the arm remains in a first angular position. In some embodiments, the method 762 may include applying a torque to the arm to rotate the arm about a pivot connection at 766. The method may include rotating the arm about the pivot connection from the first angular position to a second angular position. When the arm is in the second angular position, the user may insert the pin into a second hole of the adjustment plate to secure the arm in the second angular position at 768.

In some embodiments, the method 762 may be performed by a single user using a single hand. For example, removing the pin, applying the torque, and inserting the pin may be performed with the same hand. This may help to improve the accessibility and/or ease-of-use of the exercise device. In particular, this may help to increase the usability of the exercise device for all users, including a person with a disability, such as a person that only has the use of one hand or arm.

INDUSTRIAL APPLICABILITY

This disclosure generally relates to devices, systems, and methods for single-handed adjustment of an arm of a cable operated exercise device. To change the arm position, a user may pull on a knob or dial to unlock a position change mechanism. The arm is counterbalanced about a pivot connection so that the arm retains its position until the user moves it into a new position. After the user moves the arm into a new position, the user may push on the knob or dial and lock the arm in the new position. Because the arm is counterbalanced about the pivot connection, the entire adjustment of the arm may be performed with a single hand, in at least one embodiment. This may increase the access and/or ease-of-use of the exercise device for all users, including individuals having disabilities that may prevent them from using the exercise device with two hands.

In some embodiments, an exercise device includes a frame and a flywheel supported by the frame. A user may perform exercises by pulling on a handle connected to a cable. The cable may be connected to the flywheel such that extending the cable (e.g., by pulling the cable with the handle) may rotate the flywheel. The flywheel may include a retraction mechanism that may cause the cable to be retracted. The retraction mechanism may include a ratcheting hub or freewheel hub that allows for the transfer of torque in a first rotational direction, but not in a second rotational direction. In some embodiments, the retraction mechanism may include a biasing element (such as a torsion spring) that may urge the cable to move into a retracted position. In this manner, when the user extends the cable, the retraction mechanism may retract the cable, leaving the cable available to be extended again.

The mass of the flywheel may resist rotation when the cable is extended. In this manner, a user may exercise one or more muscles by pulling on the handle and the cable in a particular motion. In some embodiments, the flywheel may include a resistance mechanism that may impede rotation of the flywheel. The resistance mechanism may apply a force to the flywheel; a larger resistive force applied to the flywheel may result in a larger force used by the user on the cable to rotate the flywheel. The user may adjust or tailor the rotational resistance of the flywheel to a desired resistance level, which may correspond to a desired level of force to extend the cable. In some embodiments, the level of resistance may be associated with a weight (e.g., 1 lb., 5 lb., 10 lb., 20 lb., 50 lb.), and the force used to extend the cable 108 may be the same as or similar to the force used to lift or move a free weight having the indicated weight. The resistance mechanism may be any type of resistance mechanism, such as a mechanical resistance mechanism (e.g., a brake), an electric resistance mechanism, a magnetic resistance mechanism, a fluid-based resistance mechanism, any other resistance mechanism, and combinations thereof.

During use, to exercise different muscles, the user may perform one or more exercise activities that involve extending the cable by pushing or pulling on the handle. Different exercise activities may involve different motions by the user, including different motions that may involve different body positioning. In accordance with embodiments of the present disclosure, the exercise device may include one or more arms. The arms may be moved or rotated into different positions. The cable may be routed through a pulley system in the arm to the flywheel. When the retraction mechanism retracts the cable, the handle may be pulled up against or close to a distal end of the arm. The user may adjust the position of the arm to place the distal end in a desired location. This may allow the user to pull or push on the handle from a particular height and/or angle, thereby enabling the user to exercise a particular muscle or group of muscles. In some embodiments, the exercise device may include two arms, and the user may move both arms into complementary positions to perform an exercise using both handles.

In some embodiments, the lateral position of the arm may be adjusted. For example, the arm may rotate about a lateral axis of rotation. This may cause the arm to rotate into and out of the page. In some embodiments, the vertical position of the arm may be adjusted about a pivot connection. The pivot connection may have a vertical axis of rotation. By rotating the arm about the lateral axis of rotation and/or the vertical axis of rotation, the user may position the distal end of the arm at any desired location. In some embodiments, the arm may be connected to the frame with any type of connection, such as a hinge. In some embodiments the lateral position of the arm may be changed independently of the vertical position of the arm. Put another way, the arm may include a lateral adjustment mechanism and a separate vertical adjustment mechanism.

In some embodiments, the vertical angular position of the arm may be maintained using a vertical adjustment mechanism. The adjustment mechanism may be any type of adjustment mechanism used to adjust the angular position of the arm. In some embodiments, the adjustment mechanism includes an adjustment pin configured to be inserted into a hole of an adjustment plate. When the adjustment pin is inserted into the adjustment plate, an interaction between the adjustment pin and the hole in the adjustment plate may prevent the arm from being moved vertically. When the adjustment pin is removed from the hole, the arm may be rotated about the vertical axis of rotation. In some embodiments, the adjustment pin may be a cylinder with a spherical or partially spherical knob secured to the end of it.

In some situations, a user having a disability may desire to use the exercise device. For example, the user may have one hand or arm. Conventional exercise devices, however, may utilize two hands to change the position of the arm. For example, conventionally, a user may use a first hand to pull on adjustment pin, and while actively pulling on the adjustment pin, the user may change the position of the arm with his or her second hand. Indeed, before pulling the adjustment pin, the user may support the arm so that it does not fall down and injure the user. This may make adjustment by a person having a single arm or hand difficult, dangerous, and/or not feasible.

In accordance with embodiments of the present disclosure, the vertical and/or horizontal position of the arm may be adjusted with a single hand. Put another way, the vertical and/or horizontal position of the arm may be adjusted with a single user's single hand. For example, the arm may be counterbalanced about the pivot connection (e.g., about the vertical axis of rotation). In this manner, when the adjustment pin is removed from the adjustment plate, the arm may not rotate about the pivot connection absent an outside force. This may allow the user to use a single hand to pull the adjustment pin out of the adjustment plate and place the adjustment pin in a locked open position, where the adjustment pin remains out of the hole of the adjustment plate. The user may pull the adjustment pin out of the adjustment plate without supporting the arm and without the arm changing position. After placing the adjustment pin in the locked open position, the user may remove his or her hand from adjustment pin and use the hand to change the vertical angular position of the arm. When the user places the arm in the desired vertical angular position, the user may remove his or her hand from the arm and insert the adjustment pin into the adjustment plate. In this manner, the user may easily adjust the vertical angular position of the arm with a single hand. This may help to improve the access and/or ease-of-use of the exercise device for all users, including for people with disabilities, thereby improving the exercise experience. This may further help to improve the safety of the user while adjusting the position of the arm by reducing the likelihood of inadvertent movement of the arm.

In some embodiments, an arm assembly may be configured to connect to the frame of an exercise device. The arm assembly includes an arm having a proximal end and a distal end. The proximal end may be connected to an adjustment mechanism, which may allow the vertical angle of the arm to be adjusted. The adjustment mechanism may include an adjustment plate. The adjustment plate may be rigidly connected to the arm. Put another way, the adjustment plate may rotate with the arm as the arm is rotated. In some embodiments, the arm and the adjustment plate may rotate about the vertical rotational axis.

The adjustment mechanism may include a cover plate. The cover plate may be placed over the adjustment plate. An adjustment pin may extend through the cover plate to the adjustment plate. The adjustment plate may include one or more positioning holes. The adjustment pin may extend into one of the positioning holes. When the adjustment pin is located in the positioning hole, the contact of the adjustment pin with the positioning hole may prevent rotation of the arm.

To adjust the vertical angular position of the arm, the user may pull the adjustment pin out of the positioning hole. In some embodiments, the user may pull the adjustment pin in a direction parallel to the vertical rotational axis. This may remove the interference between the adjustment pin and the positioning hole, thereby allowing the arm to be moved or rotated. As discussed herein, the arm may be counterbalanced about the vertical rotational axis. When the user pulls the adjustment pin out of the positioning hole, the arm may remain in the vertical rotational position until the user moves the arm.

To move the arm, the user may apply a torque to a pivot connection about the vertical rotational axis. This may cause the arm to change vertical angular position of the arm. For example, the user may apply a torque in a first direction. This may cause the arm to rotate counter-clockwise. In some examples, the user may apply a torque in a second direction. This may cause the arm to rotate clockwise.

In some embodiments, to change the vertical angular position of the arm the user may apply a torque in the first direction. As may be seen, when rotating the arm about the vertical rotational axis, the adjustment plate may rotate about the vertical rotational axis. The cover plate and the adjustment pin may not rotate with the arm (e.g., may remain stationary). The positioning holes may move relative to the adjustment pin. The user may rotate the arm and the adjustment plate until a particular positioning hole is aligned with the adjustment pin. The user may then push or insert the adjustment pin into the positioning hole to secure the arm in a new vertical angular position. In some embodiments, the adjustment plate may include any number of positioning holes. For example, the adjustment plate may include 2, 3, 4, 5, 6, 7, 8, 9, 10, 11, 12, 13, 14, 15, or more positioning holes.

In accordance with embodiments of the present disclosure, to single-handedly adjust the angular position of the arm, when the user pulls the adjustment pin out of the positioning hole on the adjustment plate, the adjustment pin may remain extended or removed from the positioning hole. The user may then remove his or her hand from the adjustment pin to move the arm. When the user places the arm in the desired angular position, the user may push the adjustment pin back into the positioning hole. In this manner, a single user may use a single hand to adjust the angular position of the arm. This may improve the accessibility and/or ease-of-use of a connected exercise device for all users, including a person with a disability.

In some embodiments, an arm assembly includes an arm. The arm may be connectable to a frame of a cable operated exercise device with a pivot connection. The pivot connection may be any type of rotary connection, such as a hinge, a shaft in a cylinder, a bushing, a bearing, any other rotary connection, and combinations thereof. The arm may rotate about a vertical rotational axis. An adjustment plate may be rigidly connected to the arm so that the adjustment plate rotates about the vertical rotational axis. In some embodiments, an adjustment pin is inserted into a positioning hole. This may lock the arm in a vertical rotational position.

As discussed herein, the arm may be counterbalanced about the vertical rotational axis. To counterbalance the arm, a counterweight may be connected to a proximal end of the arm. The counterweight may be connected to the arm on a first side of the pivot connection. The arm may be located on the first side of the pivot connection. The counterweight may extend past the arm to a second side of the pivot connection, opposite the first side. The counterweight may include an offset member, an extension member, and a weight. The offset member may be connected to the arm on the first side of the pivot connection and offset the extension member and the weight away from the arm so that the extension member and/or the weight do not contact the arm or interfere with its operation. The extension member may extend parallel or approximately parallel to the arm toward the vertical axis of rotation and/or the pivot connection. The extension member may extend past the vertical axis of rotation and/or the pivot connection to the second side of the pivot connection. The weight may be connected to the extension member on the second side of the pivot connection. The weight may be located opposite the arm about the pivot connection and/or the vertical axis of rotation.

In accordance with embodiments of the present disclosure, the counterweight may balance the rotational forces on the arm about the pivot connection and/or the vertical axis of rotation. For example, the arm has a mass, the weight of which applies a torque in a first direction to the pivot connection based on the force of gravity. Absent an outside force, the weight of the arm may cause the arm to rotate about the pivot connection when the adjustment pin is removed from the adjustment plate. This may make adjustment of the vertical position of the arm difficult to perform single-handedly. The counterweight may be configured to counteract or balance out the torque on the pivot connection caused by the arm.

To counteract the torque on the pivot connection, the counterweight has a weight. The weight has a mass, the weight of which applies a torque in a second direction to the pivot connection based on the force of gravity. In accordance with embodiments of the present disclosure, the mass of the weight may be selected to apply an equal or approximately equal torque to the pivot connection as the arm. This may result in a net zero torque on the pivot connection. In this manner, when the adjustment pin is removed from the adjustment plate, the vertical angular position of the arm may not change. This may improve the ease of use and/or adjustment of the vertical angular position of the arm.

In some embodiments, the counterweight may only be connected to the exercise device at the pivot connection. Put another way, the counterweight may not have any pistons, gas cylinders, cables, or other elements that are connected to both the counterweight and the frame of the exercise device. In some embodiments, the arm may only be connected to the exercise device at the pivot connection. Put another way, the arm may not have any pistons, gas cylinders, cables, or other elements that are connected to both the arm and the frame of the exercise device. In some embodiments, the only element that is connected to the arm to make adjusting the angular position of the arm easier may be the counterweight.

The arm assembly has a net torque. The net torque may be the sum of the torque applied by the arm and the torque applied by the counterweight. In some embodiments, the net torque may be equal to zero. Put another way, the arm assembly may have zero or no net torque. A zero net torque may be any net torque applied to the pivot connection that is insufficient to cause the arm to change angular position. In some embodiments, one of the torque applied by the arm or the torque applied by the counterweight may be greater than the other, while still resulting in a net torque of zero because the net torque is too small to move the arm (e.g., move the combined mass of the arm and counterweight, overcome the friction forces on the pivot connection).

In some embodiments, the weight may be positioned opposite the arm across the pivot connection. In some embodiments, the weight may be positioned diametrically opposite (e.g., 180 degrees across from) the arm about the pivot connection. In some embodiments, the mass of the weight may be the same as the mass of the arm. In some embodiments, the mass of the weight may be different from the mass of the arm. In some embodiments, the center of mass of the weight may be located the same distance from the vertical rotational axis as the center of mass of the arm. In some embodiments, the center of mass of the weight may be located a different distance away from the vertical rotational axis as the center of mass of the arm.

As discussed herein, to change the vertical angular position of the arm, the user may pull the adjustment pin out of the adjustment plate. The user may then apply a torque to the arm assembly. Because the arm is counterbalanced about the pivot connection, the applied torque may be sufficient to rotate the mass and overcome friction in the pivot connection. In some embodiments, the applied torque may be in a range having an upper value, a lower value, or upper and lower values including any of 0.1 Nm, 0.5 Nm, 1 Nm, 1.5 Nm, 2.0 Nm, 2.5 Nm, 3.0 Nm, 4 Nm, 5 Nm, 6 Nm, 7 Nm, 8 Nm, 9 Nm, 10 Nm, 20 Nm, 30 Nm, 40 Nm, 50 Nm, or any value therebetween. For example, the applied torque may be greater than 0.1 Nm. In another example, the applied torque may be less than 50 Nm. In yet other examples, the applied torque may be any value in a range between 0.1 Nm and 50 Nm. In some embodiments, it may be critical that the applied torque is less than 20 Nm to allow a single user to change the vertical position of the arm with a single hand.

In some embodiments, the adjustment pin is in a closed position, where the adjustment pin is inserted into one of the positioning holes. In some embodiments, the adjustment pin is in an open position, where the adjustment pin is removed from all of the positioning holes. In some embodiments, the adjustment pin may move parallel to the vertical axis of rotation. The adjustment pin may be held in place and/or guided by a cover plate. The adjustment pin and the cover plate may be stationary relative to the arm and the adjustment plate. Put another way, the arm and the adjustment plate may be rotatable relative to the cover plate and the adjustment pin. To adjust the position of the arm, when the adjustment pin is removed from the adjustment plate, the arm and the adjustment plate may be moved relative to the cover plate until the desired positioning hole is aligned with the adjustment pin. To lock the arm in place, the user may insert the adjustment pin into the positioning hole.

In some embodiments, the adjustment pin may be biased toward the closed position. For example, the cover plate may include one or more biasing elements that urge the adjustment pin toward the adjustment plate. To remove the adjustment pin, the user may pull on the adjustment pin, overcoming the biasing force, until the adjustment pin is removed from the positioning hole. In some embodiments, when the user lets go of the adjustment pin (e.g., when the force the user is applying to the adjustment pin no longer overcomes the biasing force), the biasing element may move the adjustment pin toward the adjustment plate. This may help to prevent inadvertent removal of the adjustment pin from the adjustment plate, and therefore inadvertent movement of the arm during use.

In some embodiments, to allow for single-handed adjustment of the vertical angular position of the arm, the cover plate may include a locking mechanism. The locking mechanism may lock the adjustment pin in the open position. This may allow the user to let go of the adjustment pin and change the position of the arm. In some embodiments, the locking mechanism may be actively engaged and disengaged. For example, to engage the locking mechanism, the user may rotate the adjustment pin. This may further help to prevent inadvertent insertion of the adjustment pin into a positioning hole.

In some embodiments, the locking mechanism may be automatically engaged. For example, the locking mechanism may include an index and pin mechanism. A cylinder may include an indexing track and the adjustment pin may include an indexing pin. Pulling the adjustment pin may cause the indexing pin to engage the indexing track, rotating the cylinder. The indexing track may include a locked-open position, where the indexing pin may rest in a saddle or trough in the indexing track. When the arm is in the desired position, the user may pull on the adjustment pin, contacting the indexing track and rotating the cylinder so that when the user releases the adjustment pin, the indexing pin rests in a closed position on the cylinder.

In some embodiments, a locking mechanism may be connected to or an integral portion of the cover plate. The cover plate includes a bore through which an adjustment pin is inserted. The adjustment pin includes a protrusion extending from an outer surface of the adjustment pin. The protrusion may include a bar, a pin, a bead, or any other element extending from the adjustment pin.

The cover plate includes a notch. When the protrusion is aligned with the notch, the adjustment pin may move in and out of the bore (e.g., into and out of the page). In the closed position, the protrusion may be located in the notch between two sides of the cover plate. When the user pulls the adjustment pin from the closed position to the open position, the protrusion may extend past a ledge on the cover plate. The user may then rotate the adjustment pin so that the protrusion is oriented over the ledge.

In some embodiments, the adjustment pin and the protrusion have been rotated until the adjustment pin is located over the ledge. When the user releases the adjustment pin, the protrusion may rest on the ledge. This may place the adjustment pin in the single-hand open position. In the single-hand open position, the adjustment pin may engage or contact the ledge, which may prevent the adjustment pin from moving into the closed position. Put another way, the ledge prevents the adjustment pin from moving into the closed position from the single-hand open position. This may allow the user to release the adjustment pin and move the arm with the same hand. This may improve the ease-of-use and/or the accessibility of the adjustment mechanism of the cable operated exercise device for all users, including a person with a disability.

In a locked position, the adjustment pin and the protrusion have been rotated so that the protrusion is oriented over and resting on the ledge. As discussed herein, this may prevent the adjustment pin from being inserted into a positioning hole. In some embodiments, the ledge may include a ramp. The ramp may be angled away from the notch. This may help to place the protrusion in a saddle on the ledge. The ramp may further help to prevent inadvertent movement of the protrusion into the notch.

In some embodiments, the ledge may include a stop. The stop may help to prevent the protrusion from extending too far into a cavity of the cover plate. In some embodiments, the move the adjustment pin from the single-hand open position to the closed position, the user may simply rotate the adjustment pin. As the adjustment pin is rotated, the protrusion may be urged up the ramp. When the protrusion reaches the notch, a biasing element may urge the adjustment pin into a positioning hole in the adjustment plate. In some embodiments, the slope of the ramp may be shallow enough to allow the user to rotate the adjustment pin without pulling on the it. This may make it easy to return the adjustment pin back into the locked position with a single motion or a single hand. This may improve the accessibility and/or the ease-of-use of adjusting the vertical angular position of the arm for all users, including a person with a disability.

In some embodiments, an arm assembly has an adjustment dial that is used to adjust the vertical angular position of the arm. The adjustment dial may be coaxial with a vertical rotation axis of the arm. The adjustment dial may be rotationally fixed to the arm. To rotate the arm, the user may rotate the adjustment dial. The cover plate may include one or more positioning holes. The adjustment dial may include an adjustment pin that may be inserted into the positioning holes. To change the vertical angular position of the arm, the user may pull on the adjustment dial until the adjustment pin has been removed from the positioning hole. The user may then rotate the adjustment dial, thereby rotating the arm.

When the arm is in the desired vertical angular position, the user may push on the adjustment dial until the adjustment pin has been inserted into a positioning hole associated with the desired position of the arm. In some embodiments, the adjustment dial may be biased toward the cover plate, and the user may release the adjustment dial to return it to the locked position. Using the adjustment dial to adjust the position of the arm may allow a single user to adjust the position of the arm with a single hand. In some embodiments, the user may adjust the position of the arm without removing his or her hand from the adjustment dial. This may help to improve the ease-of-use and/or accessibility of adjusting the vertical angular position of the arm for all users, including a person with a disability.

In some embodiments, an arm assembly includes an arm. The arm may be connectable to a frame of a cable operated exercise device with a pivot connection. The arm may rotate about a vertical rotational axis. An adjustment dial may be connected to the arm at the pivot connection. In some embodiments, the adjustment dial may be rotationally fixed to the arm. Put another way, the adjustment dial may be connected to the arm such that rotating the adjustment dial may rotate the arm. In some embodiments, the adjustment dial may be coaxial with the pivot connection. In some embodiments, the adjustment dial may be coaxial with the vertical rotational axis. The arm assembly may further include a cover plate. In some embodiments, the cover plate may include one or more positioning holes. When the adjustment dial is located in the locked position, an adjustment pin connected to the adjustment dial may be inserted into a positioning hole on the cover plate. Thus, in some embodiments, the cover plate may be considered an adjustment plate. The arm and the adjustment dial may be rotatable relative to the cover plate.

To change the vertical rotational position, the user may pull on the adjustment dial to pull the adjustment pin out of the positioning hole into the open position. As may be seen, in the open position, the adjustment pin may be pulled out of the cover plate. To change the vertical angular position of the arm, the user may apply a torque to the adjustment dial. When the arm is in the desired vertical angular position, the user may push the adjustment dial in toward the cover plate, which may insert the adjustment pin into a positioning hole in the cover plate. This may move the adjustment dial back into the locked position.

As discussed herein, the arm assembly may be counterbalanced about the pivot connection and/or the vertical rotational axis with a counterweight. This may allow a single user to adjust the position of the arm by rotating the adjustment dial with a single hand (e.g., without a supporting hand on the arm or any other portion of the arm assembly). By using an adjustment dial, the user may pull the adjustment dial out, rotate the adjustment dial until the arm is in the desired position, and push the adjustment dial back into the locked position in a single continuous action, without taking his or her hand off of the adjustment dial. This may allow for easy adjustment of the arm, thereby improving the accessibility of the exercise device for all users, including a person with a disability.

While embodiments of the present disclosure have discussed an adjustment pin that is connected to the adjustment dial, and positioning holes located in the cover plate, it should be understood that other configurations may be contemplated. For example, the adjustment pin may be fixed to the cover plate, and the adjustment dial may include a plurality of positioning holes. Pulling the adjustment dial away from the cover plate may remove the adjustment pin from the current adjustment hole in the adjustment dial. And pushing the adjustment dial toward the cover plate may push the adjustment pin into the new adjustment hole in the adjustment dial.

In some embodiments, a method for adjusting an angular position of an arm of an exercise device includes removing a pin of an adjustment mechanism from a first hole of an adjustment plate. The arm may be counterbalanced such that, when the pin is removed, the arm remains in a first angular position. In some embodiments, the method may include applying a torque to the arm to rotate the arm about a pivot connection. The method may include rotating the arm about the pivot connection from the first angular position to a second angular position. When the arm is in the second angular position, the user may insert the pin into a second dhole of the adjustment plate to secure the arm in the second angular position.

In some embodiments, the method may be performed by a single user using a single hand. For example, removing the pin, applying the torque, and inserting the pin may be performed with the same hand. This may help to improve the accessibility and/or ease-of-use of the exercise device for all users, including a person with a disability. In particular, this may help to increase the usability of the exercise device for a person with a disability, such as a person that only has the use of one hand or arm.

In some embodiments, the method may include placing the pin in a single-hand open position after removing the pin from the first hole. In the single-hand open position, the user may release the pin and the pin may remain removed from the hole. Before inserting the pin into the second hole, the method may include removing the pin from the single-hand open position. In some embodiments, the pin may be rotated in a first direction to place the pin into the single-hand open position and rotated in a second position to remove the pin out of the single-hand open position.

Following are sections in accordance with embodiments of the present disclosure:

A1. An exercise device, comprising:
- a frame;
- a flywheel supported by the frame;
- a cable connected to the flywheel, wherein an extension of the cable is configured to rotate the flywheel;
- an arm connected to the frame, the arm including a pulley system routing the cable to the flywheel;
- a pivot connection between the arm and the frame, an angular position of the arm relative to the frame being adjustable about the pivot connection;
- a counterweight connected to the arm at the pivot connection, the counterweight counterbalancing the arm about the pivot connection; and
- an adjustment mechanism to adjust the angular position of the arm about the pivot connection, including:
  - an adjustment plate including a plurality of holes; and
  - an adjustment pin moveable with a single hand between a closed position and an open position, wherein in the closed position the adjustment pin is inserted into one of the plurality of holes to lock the angular position of the arm and in the open position, the adjustment pin is removed from the one of the plurality of holes and prevented from moving into the closed position and the angular position of the arm is adjustable about the pivot connection.

A2. The exercise device of section A1, wherein the adjustment mechanism includes a locking mechanism, the locking mechanism including a protrusion and a ledge, and wherein, in the open position, a contact between the protrusion and the ledge prevents the adjustment pin from moving from the open position to the closed position.

A3. The exercise device of section A2, wherein the ledge includes a ramp, and wherein a rotation of the adjustment pin moves the adjustment pin out of the open position.

A4. The exercise device of section A2 or A3, wherein the locking mechanism is located in a cover plate, and wherein the adjustment plate is rotatable relative to the cover plate.

A5. The exercise device of any of sections A1-A4, wherein the angular position of the arm is a vertical angular position.

A6. The exercise device of any of sections A1-A5, wherein, when the adjustment pin is in the open position, the arm has a net torque of zero about the pivot connection.

A7. The exercise device of any of sections A1-A6, wherein the adjustment plate is rotationally fixed to the arm.

A8. The exercise device of any of sections A1-A7, wherein the adjustment pin includes a biasing element biasing the adjustment pin toward the closed position.

B1. An exercise device, comprising:
- a frame;
- a flywheel supported by the frame;
- a cable connected to the flywheel, wherein an extension of the cable is configured to rotate the flywheel;
- an arm connected to the frame, the arm including a pulley system routing the cable to the flywheel;
- a pivot connection between the arm and the frame, an angular position of the arm relative to the frame being adjustable about the pivot connection;
- a counterweight connected to the arm at the pivot connection, the counterweight counterbalancing the arm about the pivot connection; and
- an adjustment mechanism to adjust the angular position of the arm about the pivot connection, including:
  - an adjustment plate including a plurality of holes; and
  - an adjustment dial connected to and rotationally fixed to the arm and the counterweight, the adjustment dial including a pin that is insertable into a hole of the plurality of holes.

B2. The exercise device of section B1, wherein the adjustment dial is coaxial with the pivot connection.

B3. The exercise device of section B1 or B2, wherein the adjustment dial is moveable between a closed position and an open position, wherein in the closed position, the pin is inserted into the hole of the plurality of holes and in the open position the pin is removed from all holes of the plurality of holes.

B4. The exercise device of section B3, wherein the adjustment dial is moveable parallel to a rotation axis of the pivot connection.

B5. The exercise device of section B3 or B4, wherein, when the adjustment dial is in the open position, the arm has a net torque of zero about the pivot connection.

B6. The exercise device of any of sections B3-B5, wherein, when the adjustment dial is in the open position, the angular position of the arm is adjustable with an applied torque of 3 Nm.

B7. The exercise device of any of sections B1-B6, wherein the angular position of the arm is a vertical angular position.

B8. The exercise device of any of sections B1-B7, wherein the adjustment dial includes a biasing element biasing the adjustment dial toward a closed position C1. A method for adjusting an angular position of an arm of an exercise device, comprising:
- removing a pin of an adjustment mechanism from a first hole of an adjustment plate, wherein the arm is counterbalanced such that, when the pin is removed, the arm remains in a first angular position;

applying a torque to the arm to rotate the arm about a pivot connection from the first angular position to a second angular position; and inserting the pin into a second hole of the adjustment plate to secure the arm in the second angular position.

C2. The method of section C1, wherein removing the pin, applying the torque, and inserting the pin are performed using a user's single hand.

C3. The method of section C1 or C2, wherein applying the torque includes applying a torque of 3 Nm.

C4. The method of any of sections C1-C3, further comprising placing the pin in an open position after removing the pin from the first hole.

C5. The method of section C4, further comprising, removing the pin from the open position before inserting the pin into the second hole.

C6. The method of section C5, wherein placing the pin in the open position includes rotating the pin in a first direction and removing the pin from the open position includes rotating the pin in a second direction.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An exercise device, comprising:

a frame;

a flywheel supported by the frame;

a cable connected to the flywheel, wherein an extension of the cable is configured to rotate the flywheel;

an arm connected to the frame, the arm comprising a pulley system routing the cable to the flywheel;

a pivot connection between the arm and the frame, wherein an angular position of the arm relative to the frame is adjustable about the pivot connection;

a counterweight connected to the arm at the pivot connection, the counterweight counterbalancing the arm about the pivot connection; and an adjustment mechanism to adjust the angular position of the arm about the pivot connection, the adjustment mechanism comprising:

an adjustment plate comprising a plurality of holes;

an adjustment pin moveable between a closed position and an open position, wherein, in the closed position, the adjustment pin is inserted into one hole of the plurality of holes to lock the angular position of the arm, and wherein, in the open position, the adjustment pin is removed from the one hole of the plurality of holes, the adjustment pin is prevented from moving into the closed position, and the angular position of the arm is adjustable about the pivot connection; and a locking mechanism comprising a protrusion and a ledge, wherein, in the open position, a contact between the protrusion and the ledge prevents the adjustment pin from moving from the open position to the closed position, wherein the ledge comprises a ramp, and wherein a rotation of the adjustment pin moves the adjustment pin out of the open position.

2. The exercise device of claim 1, wherein the locking mechanism is located in a cover plate, and wherein the adjustment plate is rotatable relative to the cover plate.

3. The exercise device of claim 1, wherein the angular position of the arm is a vertical angular position.

4. The exercise device of claim 1, wherein, when the adjustment pin is in the open position, the arm has a net torque of zero about the pivot connection.

* * * * *